US010150297B2

(12) United States Patent
Arimizu et al.

(10) Patent No.: US 10,150,297 B2
(45) Date of Patent: Dec. 11, 2018

(54) PRINTING APPARATUS

(71) Applicant: CANON KABUSHIKI KAISHA, Tokyo (JP)

(72) Inventors: Hiroshi Arimizu, Kawasaki (JP); Shinya Asano, Tokyo (JP); Yusuke Imahashi, Kawasaki (JP); Masahiko Kubota, Tokyo (JP); Arihito Miyakoshi, Tokyo (JP); Yoshinori Itoh, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/603,755

(22) Filed: May 24, 2017

(65) Prior Publication Data

US 2017/0341399 A1 Nov. 30, 2017

(30) Foreign Application Priority Data

May 30, 2016 (JP) ..... 2016-107523
May 30, 2016 (JP) ..... 2016-107541

(51) Int. Cl.
*B41J 2/175* (2006.01)
*B41J 2/165* (2006.01)
*B41J 2/17* (2006.01)

(52) U.S. Cl.
CPC ..... *B41J 2/16517* (2013.01); *B41J 2/175* (2013.01); *B41J 2/1714* (2013.01)

(58) Field of Classification Search
CPC ..... B41J 2/16517; B41J 2/1714; B41J 2/175
See application file for complete search history.

(56) References Cited

U.S. PATENT DOCUMENTS 7,431,421 B2 * 10/2008 Carcia ..... B41J 2/165 347/102
9,199,472 B2 12/2015 Ishida et al.
9,358,793 B2 6/2016 Arimizu et al.
9,498,962 B2 11/2016 Ishida et al.
9,579,896 B2 2/2017 Imahashi et al.
9,701,122 B2 7/2017 Arimizu et al.
2005/0200649 A1 9/2005 Yamaguchi et al.
(Continued)

FOREIGN PATENT DOCUMENTS

EP 1 208 990 A2 5/2002

OTHER PUBLICATIONS

Yusuke Imahashi et al., U.S. Appl. No. 15/415,027, filed Jan. 25, 2017.

(Continued)

*Primary Examiner* — Jason Uhlenhake
(74) *Attorney, Agent, or Firm* — Fitzpatrick, Cella, Harper & Scinto

(57) ABSTRACT

A printing apparatus according to the present invention includes a plurality of ejection heads for ejecting liquid and a plurality of mist collection units configured to collect mist generated by the ejection heads that are disposed along a medium conveyance direction. The plurality of mist collection units include a first mist collection unit. The first mist collection unit is provided to be inclined to the upstream side of a medium conveyance direction with regard to a perpendicular line perpendicular to a floor. The first mist collection unit has a liquid retention part disposed at the upstream side than an ink mist suction hole.

9 Claims, 15 Drawing Sheets

(56) References Cited

U.S. PATENT DOCUMENTS

| | | | | |
|---|---|---|---|---|
| 2006/0238561 | A1 | 10/2006 | Carcia et al. | |
| 2009/0315937 | A1 | 12/2009 | Kubota et al. | |
| 2011/0310177 | A1 | 12/2011 | Masuda | |
| 2012/0007916 | A1 | 1/2012 | Kumagai | |
| 2013/0229460 | A1 | 9/2013 | Masuda | |
| 2015/0273835 | A1 | 10/2015 | Arimizu et al. | |
| 2016/0031218 | A1* | 2/2016 | Ishida | B41J 2/16585 347/34 |
| 2016/0221366 | A1* | 8/2016 | Washio | B41J 2/155 |

OTHER PUBLICATIONS

European Search Report issued in corresponding European Application No. 17000799.1 dated Feb. 2, 2018.

* cited by examiner

PRINTING APPARATUS

BACKGROUND OF THE INVENTION

Field of the Invention

The present invention relates to a printing apparatus for performing a printing operation using an ink ejection head for ejecting ink and a reaction liquid ejection head for ejecting reaction liquid reacting with the ink.

Description of the Related Art

An ejection head in an inkjet printing apparatus causes, in addition to ink droplets for printing an image, mist-like minute ink droplets called mist that do not contribute to the formation of an image. The minute ink droplets float in air and are attached to the ejection head and various parts in the printing apparatus to thereby cause an ejection defect of the ejection head, a deteriorated function of the printing apparatus, or a deteriorated image quality. Another printing apparatus has an ejection head to eject not only ink for printing an image but also reaction liquid reacting with ink. In the case of this type of printing apparatus, mist of reaction liquid may be generated when the reaction liquid is ejected and may be attached to the ejection port face of the ejection head for example. The reaction liquid attached to the ink near the ejection port of the ejection head promotes the fixed adhesion of the ink, which causes the inconvenience due to the mist to be more remarkable.

The specification of US Patent Laid-Open No. 2006/0238561 discloses a configuration of a printing apparatus including a plurality of ejection heads in which the respective ejection heads have therebetween a suction duct for sucking the mist and a blowoff duct for blowing air that are provided to be adjacent to each other.

In the case of the printing apparatus disclosed in the specification of US Patent Laid-Open No. 2006/0238561, a plurality of ejection heads, the suction duct, and the blowoff duct are provided along a cylinder face in a radial manner. Thus, different positions have different inclination directions to the vertical direction. Thus, a certain position causes liquefied mist attached to the duct interior to fall in drops due to the gravitational force and the liquid may fall in drops from the suction hole of the duct onto a medium.

SUMMARY OF THE INVENTION

It is an objective of the present invention to provide an apparatus by which a printing apparatus having a plurality of ejection heads and a plurality of mist collection units can be configured so that the respective mist collection units can securely retain liquid caused by liquefied mist.

According to first aspect of the invention, there is provided a printing apparatus comprising: a plurality of ejection heads for ejecting liquid; and a plurality of mist collection units configured to collect mist generated by the ejection heads that are provided along a medium conveyance direction, wherein each of the mist collection units includes a housing, a suction hole provided at the bottom of the housing to suck the mist, and a retention part provided in the housing to retain the liquid caused by liquefied mist sucked through the suction hole, and the plurality of the mist collection units include a first mist collection unit included that is provided to be inclined to a predetermined side that is one of upstream side or downstream side of the conveyance direction with regard to a perpendicular line perpendicular to a floor and the first mist collection unit has the retention part provided at the predetermined side than the suction hole.

According to second aspect of the invention, there is provided a printing apparatus comprising: a plurality of ink ejection head for ejecting ink that are disposed along a medium conveyance direction; a reaction liquid ejection head for ejecting reaction liquid reacting with the ink; and a mist collection unit, including an air blowoff hole and an air suction hole, configured to collect mist generated by the ejection heads, wherein the reaction liquid ejection head is disposed adjacent to at least one of the ink ejection head disposed in the most upstream side in the conveyance direction and the ink ejection head disposed in the most downstream side in the conveyance direction, and the mist collection unit is provided to be adjacent to each of an upstream side and a downstream side of the reaction liquid ejection head.

Further features of the present invention will become apparent from the following description of exemplary embodiments with reference to the attached drawings.

DESCRIPTION OF THE EMBODIMENTS

The following section will describe an embodiment of the present invention based on the drawings.

(First Embodiment)

Figure 1:
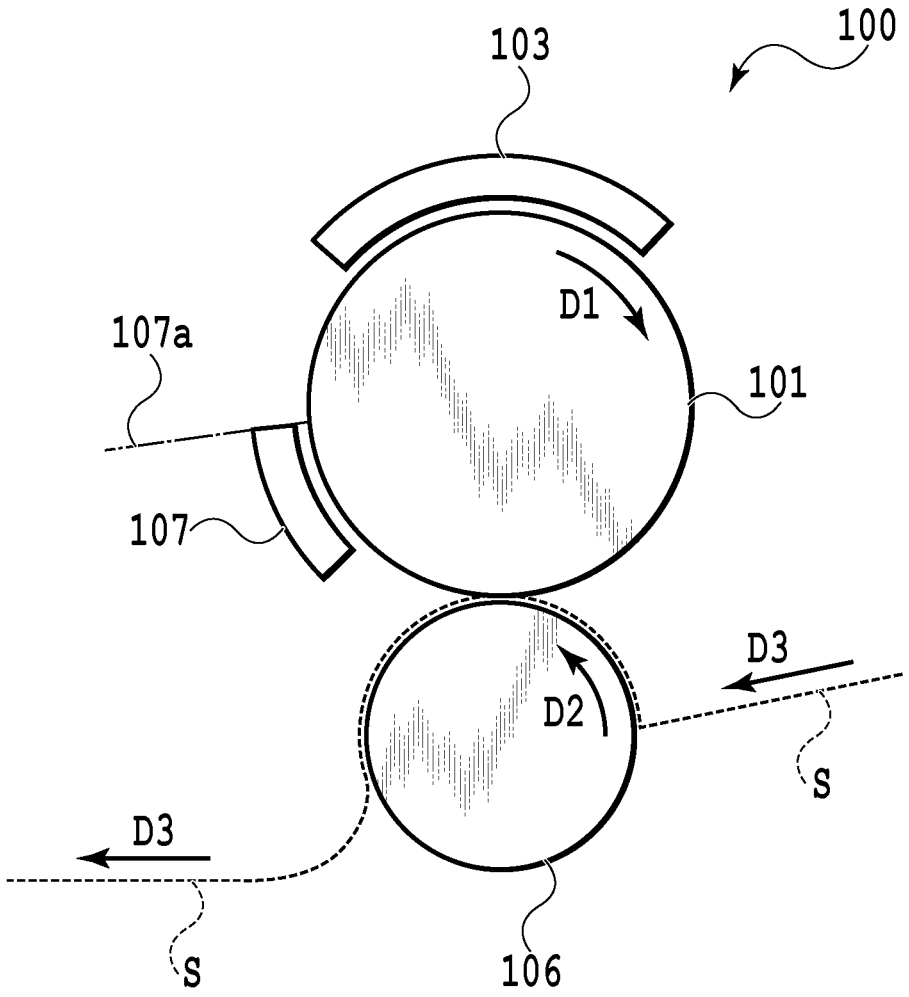
FIG. 1 is a schematic view illustrating the configuration of a printing apparatus in an embodiment.

FIG. 1 is a schematic view illustrating the configuration of an inkjet-type printing apparatus. A printing apparatus 100 is a transfer-type line printing apparatus that forms an intermediate image on a surface of a transfer body as an intermediate print medium (intermediate medium) and transfers this intermediate image onto a sheet as a final print medium.

The printing apparatus 100 includes a drum-shaped transfer body 101 having cylindrical shape and a printing unit 103 opposed to the periphery face of the transfer body 101 (cylinder curved surface). The printing unit 103 ejects ink to print an image. The printing unit 103 includes a plurality of line ejection heads for ejecting liquid that are provided in a radial manner along the periphery face direction of the transfer body 101 (medium rotation conveyance direction). Each ejection head includes a plurality of ejection ports through which liquid is ejected that are arranged along the longitudinal direction orthogonal to the paper of FIG. 1. These ejection ports constitute a longitudinal ejection port array. Liquid ejected through the respective ejection heads includes inks of a plurality of colors for forming an image and reaction liquid for improving the quality of an image formed through the reaction with the ink for example.

In order to form an image, inks of a plurality of colors and reaction liquid (which will be described later) are ejected through a plurality of ejection heads provided in the printing unit 103 while allowing the transfer body 101 to rotate in the direction D1. In this example, the transfer body 101 has a diameter of 0.9 m and is rotated at a line velocity of 0.6 m/s. However, these values are illustrative and not requisite. The rotation of the transfer body 101, the ejection of ink through the ejection head, and the ejection of the reaction liquid allow an intermediate image of the inks to be continuously formed on the surface of the transfer body 101.

On the other hand, the lower part of the transfer body 101 is opposed to a rotation body 106. The rotation body 106 rotates in the direction D2 in synchronization with the rotation of the transfer body and presses the sheet S supplied from a sheet supply section (not shown) against the surface of the transfer body 101. As a result, an intermediate image formed on the surface of the transfer body 101 is transferred onto the surface of the sheet and is transported in the transportation direction D3. The surface of the transfer body 101 for which the image transfer to the sheet is completed is cleaned by a cleaning units 107 so that the next printing operation can be started.

Figure 2:
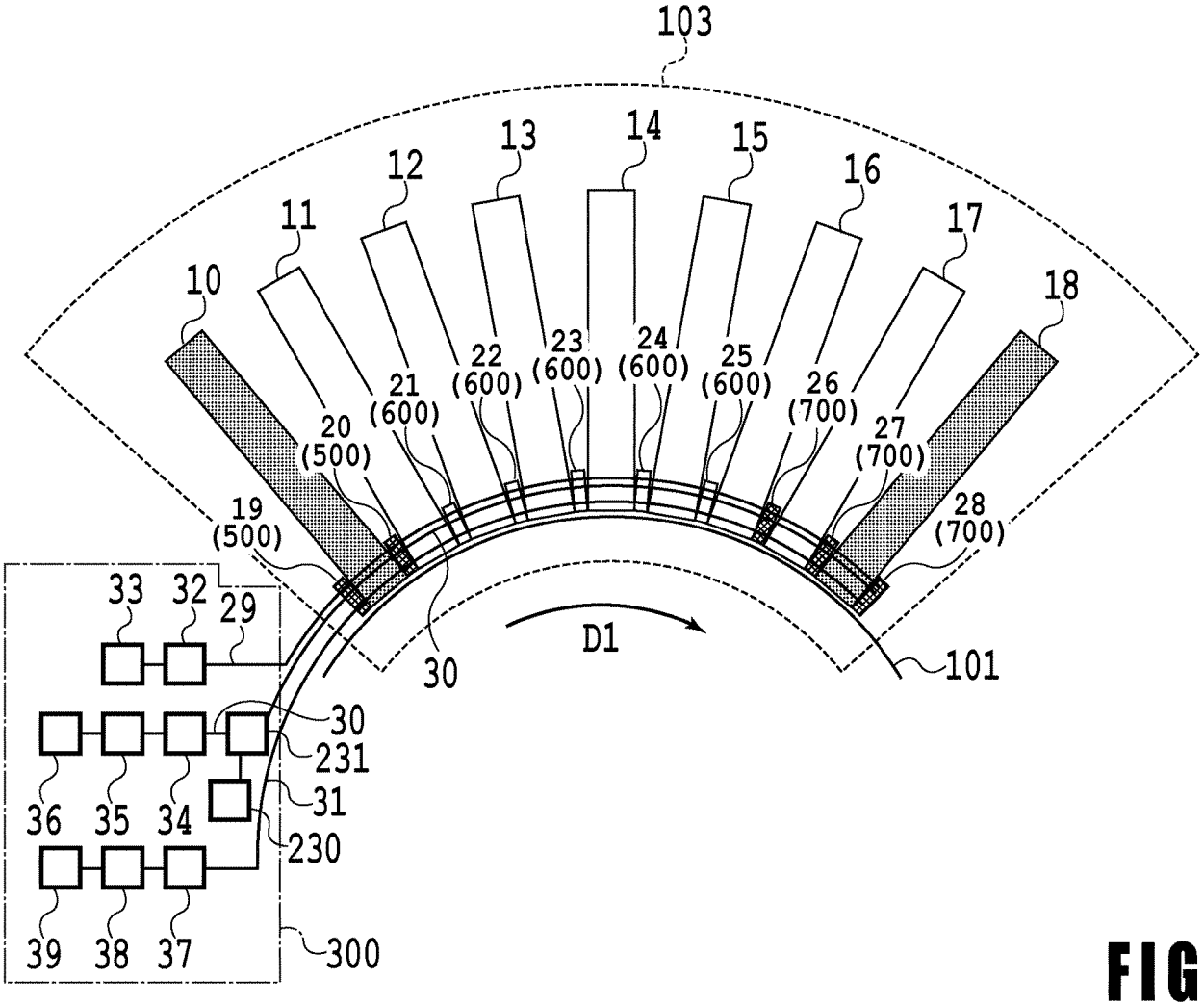
FIG. 2 is a schematic view illustrating the configuration of an ejection head and a mist collection apparatus shown in FIG. 1.

FIG. 2 is a schematic view illustrating the internal configuration of the printing unit 103 in the printing apparatus 100 shown in FIG. 1 and the configuration of the mist collection apparatus provided in the printing apparatus 100. The printing units 103 includes therein nine ejection heads 10 to 18 arranged at a predetermined intervals opposite to the periphery face of the transfer body 101. Mist collection units 19 to 28 (which will be described later) are disposed just before the ejection head 18, just after the ejection head 10, and among the respective ejection heads 10 to 18, respectively. The transfer body 101 cleaned by the cleaning units 107 receives liquid ejected based on an order in which the ejection heads are arranged. As described above, the printing unit 103 has a basic configuration in which a plurality of mist collection units and a plurality of ejection heads are alternately arranged in a radial manner along a conveyance direction (curved surface) of a medium (transfer body). The printing unit 103 is configured so that the most upstream side and the most downstream side have mist collection units.

The following description will be made based on an assumption that a position at which the transfer body 101 is away from the cleaning units 107 is a reference position 107*a*. A direction along which the transfer body 101 moves toward the reference position 107*a* in a rotation direction opposite to the rotation direction D1 of the transfer body 101 is assumed as the front side while a direction along which the transfer body 101 moves away from the reference position 107*a* is assumed as the rear side. The front side also may be called as the upstream side and the rear side may be called as the downstream side. According to this definition, the ejection head 10 is an ejection head provided at the most upstream position while the ejection head 18 is an ejection head provided at the most downstream position. The same definitions for the front side, the rear side, the upstream side, and the downstream side apply to mist collection units 19 to 28 (which will be described later).

The following section will describe the types of the plurality of ejection heads 10 to 18. The ejection heads 11 to 17 are an ink ejection head for ejecting ink in the form of droplets. Different ink types (colors) are set for the respective ejection heads. The top ejection head 10 provided at the most upstream is a pre-processing liquid ejection head (reaction liquid ejection head) to eject pre-processing liquid (reaction liquid). The pre-processing liquid is given to a portion on the transfer body 101 on which an image is to be formed and reacts with the subsequently-applied ink droplets for the purpose of improving the ink coagulation and the image quality (e.g., glossiness). The tail end ejection head 18 provided at the most downstream is a post processing liquid ejection head (reaction liquid ejection head) to eject post processing liquid (reaction liquid). The post processing liquid is given on an image formed on the transfer body 101 and reacts with ink for the purpose of improving the image weatherability and fixing property. The distance between these ejection heads 10 to 18 and the transfer body 101 is about 1 mm or less at the narrowest portion.

Next, the following section will describe the mist collection units 19 to 28 provided in the printing apparatus 100. The mist collection apparatus 100 includes mist collection units 19 to 28 to suck ink ejected through the ejection heads 10 to 18 and the reaction liquid mist to collect the ink and the reaction liquid and a suction discharge mechanism 300 to suck and discharge air for collecting the mist in the collection unit.

First, the following section will describe the mist collection units 19 to 28. The printing apparatus 100 includes three types of mist collection units 500, 600, and 700. The mist collection units 19 and 20 use the first mist collection unit (the first mist collection unit) 500. The mist collection units 21 to 25 use the second mist collection unit (the second mist collection unit) 600. The mist collection units 26 to 28 use the third mist collection unit (the first mist collection unit) 700. The first mist collection unit 500 (19, 20) and the third mist collection unit 700 (26 to 28) are both configured to generate a blowoff air current and a suction air current. The blowoff air current and the suction air current are used to suck and collect the mist floating in air. The second mist collection unit 600 (21 to 25) has a configuration to perform air suction only. The suction air current generated therein is used to suck and collect the mist floating in air.

The two types of mist collection units (the first mist collection unit 500, the third mist collection unit 700) using the blowoff air current and the suction air current are disposed to be adjacent to each other at the front and rear sides of an ejection head that is significantly influenced when the mist is leaked to an already-printed region side. The mist of the pre-processing liquid caused from the pre-processing liquid ejection head 10 in particular has a characteristic that the mist reacts with ink and is adhered in a fixed manner. Thus, when the pre-processing liquid mist reaches the ejection heads 11 to 17 or the post processing liquid ejection head 18, then a risk is caused in which the mist may be adhered in a fixed manner to a face in which the ejection port of the ejection head or the ejection port is formed (ejection port face), which may cause an ejection defect of the ejection port to cause a deteriorated image. If the pre-processing liquid mist is leaked to the front side, a risk is caused in which the mist floats in the printing apparatus 100 and is attached to various portions. Thus, the mist collection units 19 and 20 provided at the front and rear sides of the pre-processing liquid ejection head 10 use the first mist collection unit 500 to generate the blowoff air current and the suction air current at the front and rear sides of the pre-processing liquid ejection head 10. This can consequently allow the blowoff air current functioning as an air curtain to block the leakage of the mist generated from the pre-processing liquid ejection head 10 in the front and rear directions, thus sufficiently collecting the floating mist by the suction air current by the first mist collection units 19 and 20.

The pre-processing liquid mist also may be attached to the ejection port face of the pre-processing liquid ejection head 10 itself through which the pre-processing liquid was ejected, which may cause the ejection port having an ejection defect. In order to suppress the pre-processing liquid mist from being attached to the ejection port face of the pre-processing liquid ejection head 10, it is effective to cause the air current to flow between the ejection head and the print medium from the not-yet-printed region side of the ejection head. To realize this, the first mist collection units 19 provided at the front side of the pre-processing liquid ejection head 10 (the not-yet-printed region side) uses the first mist collection unit 500. A part of the blowoff air current blown off from the first mist collection units 19 can be caused to flow between the transfer body 101 and the ejection head to thereby suppress the pre-processing liquid mist from being attached to the ejection port face of the pre-processing liquid ejection head 10.

When the post processing liquid mist caused from the post processing liquid ejection head 18 reaches the ink ejection heads 11 to 17 and the pre-processing liquid ejection head 10 for example, the mist may be adhered to the ejection port faces or the ejection ports of these ejection heads in a fixed manner, causing an ejection defect. If the post processing liquid mist is leaked to the rear side (downstream side) of the post processing liquid ejection head 18, a risk is caused in which the mist floats in the printing apparatus 100 and is attached to the internal mechanism. To prevent this, the mist collection units 27 and 28 provided at the front and rear sides of the post processing liquid ejection head 18 also use the third mist collection unit 700 to generate the blowoff air current and the suction air current. This allows the post processing liquid mist generated from the post processing liquid ejection head 18 to be more securely collected using the blowoff air current and the suction air current generated by the mist collection units 27 and 28. A part of the blowoff air current generated from the mist collection unit 27 also can be allowed to flow between the ejection port face of the post processing liquid ejection head 18 and the transfer body 101 to thereby suppress the mist from being attached to the ejection port face of the post processing liquid ejection head 18 itself through which the post processing liquid was ejected.

In this embodiment, the printing unit 103 is configured so that an ejection head provided at the most downstream position functions as a post processing liquid step head. However, even when an ejection head disposed at the most downstream position is an ink ejection head, the third mist collection unit 700 is desirably provided. Specifically, when an ejection head disposed at the most downstream position is an ink ejection head, a concern is caused in which the ink mist generated from the ink ejection head is leaked to the rear side and floats in the printing apparatus and is attached to various portions. To prevent this, even when an ejection head provided at the most downstream position is an ink ejection head, mist collection units provided at the front and rear sides thereof use the third mist collection unit 700. This can more surely suppress the leakage of the ink mist to the downstream side.

Another configuration also may be used in which an ejection head around which the generation of a high amount of mist is expected is sandwiched, at the front and rear sides thereof, between the third mist collection units 700 that use the blowoff air current and the suction air current. In this embodiment, it is expected that the ink ejection head 17 generates the mist in an amount higher than those of other ejection heads. Thus, the mist collection unit 26 disposed at the front side of the ink ejection head 17 also uses the third mist collection unit 700 to generate the blowoff air current and the suction air current. Thus, even when a large amount of ink mist is generated from the ejection head 17, the third mist collection units 26 and 27 having a high mist collection capability can be used to collect the ink mist in a more secure manner. Furthermore, a part of the blowoff air current generated from the mist collection unit 26 can be allowed to flow to the lower side of the ink ejection head 17, thereby suppressing the mist from being attached to the ejection port face of the ink ejection head 17.

The second mist collection unit 600 generating the suction air current only is used when a small amount of mist is generated from an ejection head. However, in the case where the mist collection is desirably carried out in a more secure manner, then the first mist collection unit 500 or the third mist collection unit 700 generating the blowoff air current and the suction air current also can be used. The second mist collection unit 600 can have a shorter width than those of the first and third mist collection units (or can have a shorter length than the length of the transfer body 101 in the rotation direction D1). Thus, ejection heads adjacent to each other can have a shorter distance therebetween, thus providing a printing apparatus having a compact configuration. Since the second mist collection unit 600 does not generate the blowoff air current, the total air volume for collecting the mist can be reduced.

Next, the following section will describe the suction discharge mechanism 300. The mist collection unit is connected to the suction discharge mechanism 300 in which an air suction force and an exhaust air force are generated to perform the air suction and the exhaust air in the mist collection unit. The suction discharge mechanism 300 includes a pump 33 (air sending unit) for performing an air sending operation, a pump 36 for performing air suction operation (air suction unit), a pump 39 for performing a waste liquid discharge operation (discharge unit), flow rate adjustment valves 32, 35, and 38, and pipes 29, 30, and 31. The pipe 29 is provided to supply air to the mist collection units 19, 20, 26, 27, and 28. The pipe 30 is provided to supply air from the mist collection units 19 to 28. The pipe 31 is a pipe to discharge, to the exterior, liquefied liquid caused by the collection of the mist in the interior of the mist collection units 19 to 28 (mist liquid), washing liquid for washing the interior (these liquids will be hereinafter collectively referred to as waste liquid), and air including the mist (hereinafter referred to as exhaust air).

The pipe 29 is connected to the pump 33 to supply air to the first mist collection unit 500 (19, 20) and the third mist collection unit 700 (26, 27, 28). The pipe 30 is connected to the pump 36 to generate a suction force to suck air from the first, second, and third mist collection units 500, 600, and 700 (19 to 28). The pipe 31 is connected to the pump 39 to generate a suction force to discharge, together with the exhaust air, the waste liquid including the mixture of the mist liquid collected in the mist collection units 19 to 28 and the washing liquid for washing the interior of the mist collection unit for example. The pipes 29, 30, and 31 are connected to the valves 32, 35, and 38 to adjust the flow rates of the fluids flowing therein, respectively. The pipes 30 and 31 for connecting the valves 34 and 38 to the mist collection units 19 to 28 are connected to cleaning mechanisms 34 and 37 to remove dust for example included in the waste liquid and the exhaust air. At a middle of the pipe 30 for connecting the cleaning mechanism 34 to the mist collection units 19 to 28, a switching valve 231 is connected. The switching valve 231 is connected to a washing liquid injection mechanism 230. The switching valve 231 is configured so that the mist collection units 19 to 28 are allowed to selectively communicate with the cleaning mechanism 34 and the washing liquid injection mechanism 230. When the washing liquid injection mechanism 230 communicates with the mist collection units 19 to 28, the washing liquid injection mechanism 230 delivers the washing liquid to wash the interior of the mist collection units 19, 20 and 26 to 28.

Figure 3A:
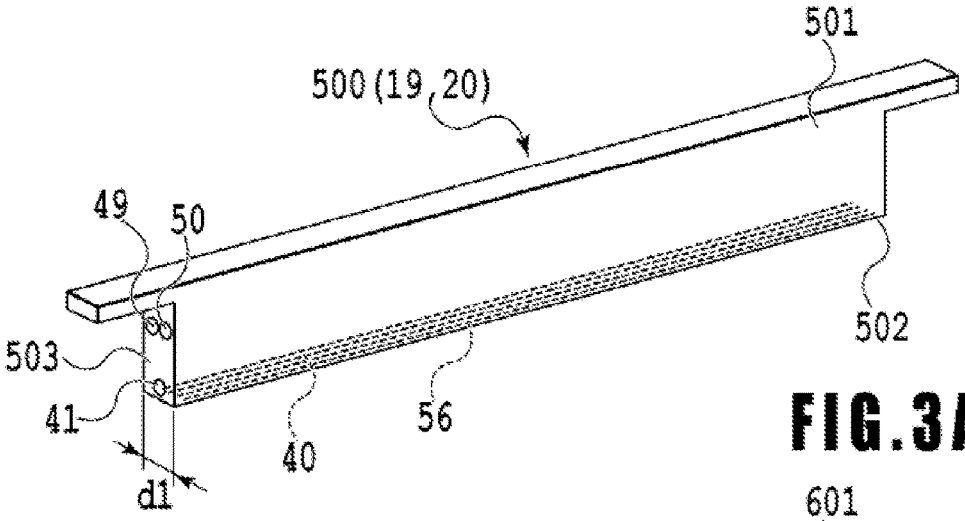
FIGS. 3A to 3C are perspective views illustrating the first, second, and third mist collection units in the mist collection apparatus.
Figure 3B:
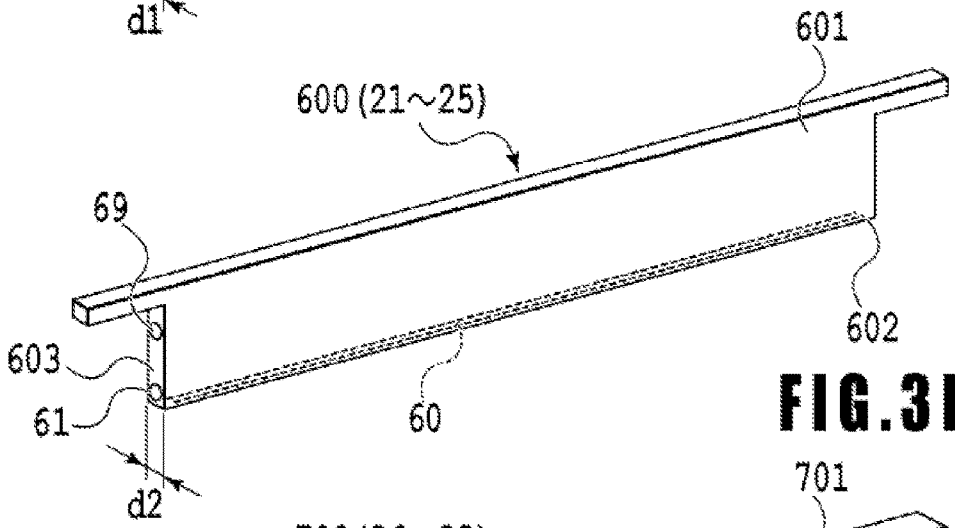
Figure 3C:
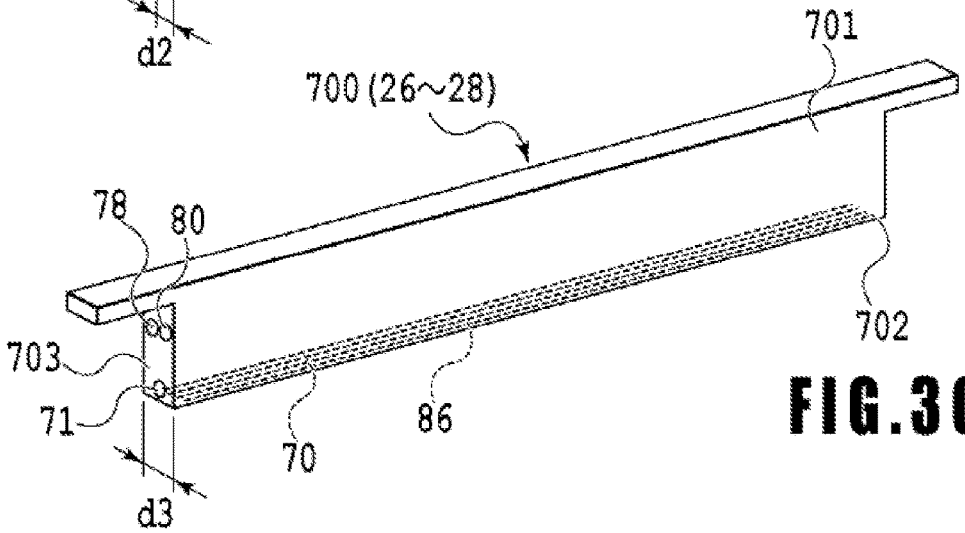

FIGS. 3A to 3C are a perspective view illustrating the appearance of the first, second, and third mist collection units. FIG. 3A illustrates the first collection unit 500, FIG. 3B illustrates the second collection unit 600, and FIG. 3C illustrates the third collection unit 700, respectively.

The first mist collection unit 500 includes a substantially rectangular parallelepiped-shaped housing 501 (the first housing) having a width d1. The housing 501 includes therein spaces such as a pressure room or a flow path (which will be described later). The housing 501 has a bottom wall 502 including a slit-like suction hole 40 and a blowoff hole 56 that are formed to be parallel to each other. The suction hole 40 and the blowoff hole 56 are formed over a range equal to or longer than the length of an ejection port array 91 formed in the ejection heads 10 to 18. The housing 501 has a side wall 503 that includes an exhaust air hole (the first exhaust air hole) 49, an air supply hole (the first air supply hole) 50, and a waste liquid discharge hole (the first waste liquid discharge hole) 41. The exhaust air hole 49 is connected to the pipe 30, the air supply hole 50 is connected to the pipe 29, and the waste liquid discharge hole 41 is connected to the pipe 31, respectively.

The second mist collection unit 600 includes a substantially rectangular parallelepiped-shaped housing 601 (the second housing) having a width d2 smaller than that of the first mist collection unit 500. The housing 601 includes therein a pressure room and a flow path (which will be described later) for example. The housing 601 has the bottom wall 602 in which a slit-like suction hole 60 is formed over the range equal to or longer than the length of the ejection port array 91 (refer to FIG. 12) formed in the ejection heads 10 to 18. The housing 601 has the side wall 603 that includes an exhaust air hole (the second exhaust air hole) 69 and a waste liquid discharge hole (the second waste liquid discharge hole) 61. The exhaust air hole 69 is connected to the pipe 30 and the waste liquid discharge hole 61 is connected to the pipe 31, respectively.

The third mist collection unit 700 has a substantially rectangular parallelepiped-shaped the housing 701 (the third housing) having a width d3. The housing 701 has a bottom wall 702 that includes, as in the suction hole 40 and the blowoff hole 56 in the first mist collection unit 500, a slit-like suction hole (the first suction hole) 70 and a blowoff hole 86. The housing 701 has a side wall 703 that includes an exhaust air hole (the first exhaust air hole) 78, an air supply hole (the first air supply hole) 80, and a waste liquid discharge hole (the first waste liquid discharge hole) 71. The exhaust air hole 78 is connected to the pipe 30, the air supply hole 80 is connected to the pipe 29, and the waste liquid discharge hole 71 is connected to the pipe 31, respectively.

Figure 4C:
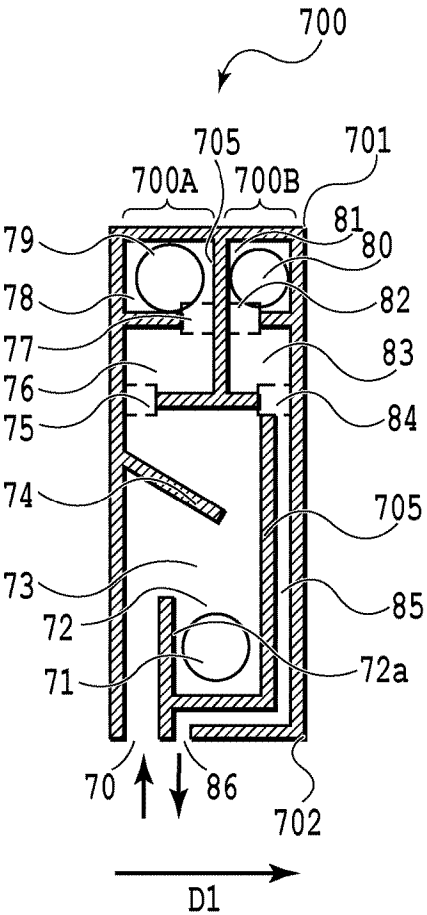
FIGS. 4A to 4C are vertical cross-sectional views illustrating the respective mist collection units shown in FIGS. 3A to 3C.
Figure 4B:
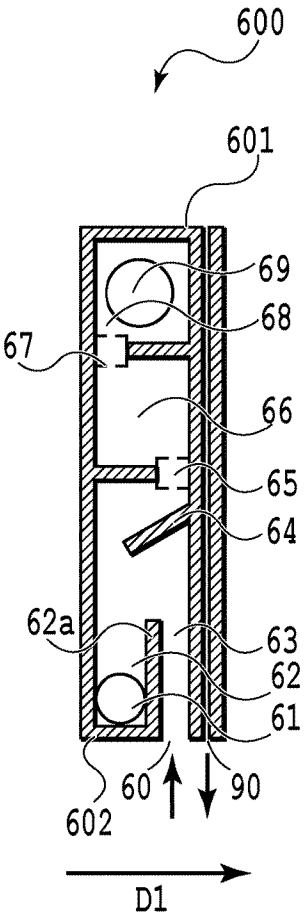
Figure 4A:
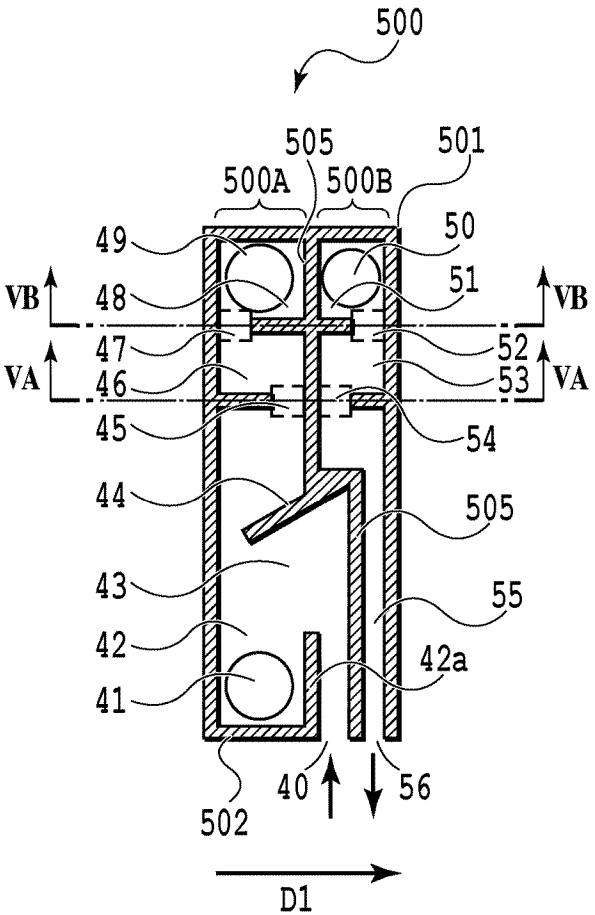

FIGS. 4A to 4C are a longitudinal side view illustrating the internal structure of the first, second, and third mist collection units 500, 600, and 700, respectively. FIG. 4A shows the first mist collection unit 500, FIG. 4B shows the second mist collection unit 600, and FIG. 4C shows the third mist collection unit 700, respectively.

The first mist collection unit 500 shown in FIG. 4A is separated by a separation wall 505 for halving the interior in the front-and-rear direction (the left-and-rear direction in FIG. 4A) into to a structure section 500A for sucking air including the mist and a structure section 500B for blowing out the air current.

First, the following section will describe the structure section 500A to suck air including the mist. The structure section 500A includes a suction flow path 43 communicating with the suction hole 40 formed in the bottom of the housing 501, a waste liquid retention part (retention part) 42, and the first and second pressure rooms (pressure rooms) 46 and 48 for example that communicate with one another. The second pressure room 48 communicates with the pipe 30 via the exhaust air hole 49 formed in the side wall 503 of the housing 501. Thus, the air in the second pressure room 48 is discharged to the exterior by the suction force of the pump 36 via the pipe 30. When the air in the second pressure room 48 is discharged, the air in the structure section 500A is allowed to flow to the exhaust air hole 49. As a result, the external air is sucked from the suction hole 40 into the structure section 500A.

The air sucked from the suction hole 40 passes through the suction flow path 43 and is partially blown to a mist trap face 44 forming the surface of a plate member provided in the housing 501. The blown mist is partially is attached to the mist trap face 44 downwardly protruding in an inclined manner from the separation wall 505. When an increased amount of the mist is attached to the mist trap face 44, the mist is collected to form liquid (waste liquid). This liquid falls in drops from the mist trap face 44 and is retained in the waste liquid retention part 42. The side wall 503 of the housing 501 in the first mist collection unit 500 (see FIG. 3A) includes the waste liquid discharge hole 41. The waste liquid discharge hole 41 is connected to the pump 39 via the pipe 31. The pump 39 is driven at a predetermined timing to thereby discharge the waste liquid retained in the waste liquid retention part 42, the exhaust air, and the housing washing liquid for example from the waste liquid retention part 42. The waste liquid and exhaust air discharged from the waste liquid retention part 42 are cleaned by the cleaning mechanism 37 and are subsequently sent through the valve 38 and are discharged through the pump 39 to the exterior.

The air flowing into the suction flow path 43 on the other hand is allowed to pass through the first pressure uniformizing member 45 provided to provide the uniform suction flow rate distribution of the mist collection unit 500 in the longitudinal direction (a direction orthogonal to the paper of FIG. 4A) is subsequently allowed to flow into the first pressure room 46. This first pressure room 46 is similarly provided to provide the uniform suction flow rate distribution in the longitudinal direction. The pressure uniformizing member and the pressure room will be described later with reference to FIGS. 5A and 5B. The air flowing in the first pressure room 46 is allowed to further pass through the second pressure uniformizing member 47 and is allowed to flow into the second pressure room 48. The second pressure room 48 communicates with an exhaust air hole 49 provided in the side wall 503 of the mist collection unit 500. Thus, the air flowing in the second pressure room 48 is discharged from the exhaust air hole 49 to the pipe 30 (see FIG. 2). From the air flowing in the pipe 30, the mist is collected in the cleaning mechanism 34 and is cleaned and is subsequently allowed to pass through the valve 35 and is discharged from the pump 36.

Next, the following section will describe the structure section 500B for blowing air. The structure section 500B includes the third pressure room 51, the fourth pressure room 53, and the blowoff flow path 55 provided so as to communicate with one another. The third pressure room 51 communicates with the pipe 29 via the air supply hole 50 formed in the side wall 503 of the housing 501. Thus, the air sent from the pump 33 is allowed to pass through the pipe 29 and the valve 32 and is subsequently allowed to flow from the air supply hole 50 into the third pressure room 51. The third pressure room 51 is provided in order to uniformize the blowoff flow rate distribution of the mist collection unit in the longitudinal direction. The air flowing in the third pressure room 51 is allowed to pass through the third pressure uniformizing member 52, the fourth pressure room 53, and the fourth pressure uniformizing member 54 to further uniformize the blowoff flow rate distribution in the longitudinal direction and the resultant air is sent to the blowoff flow path 55 and is blown off from the blowoff hole 56. The blown air is blown to the surface to the transfer body 101.

The second mist collection unit 600 shown in FIG. 4B includes the suction flow path 63 communicating with the suction hole 60 formed in the bottom wall 602 of the housing 601, the fifth pressure room 66, and the sixth pressure room 68. The sixth pressure room 68 communicates with the pipe 30 via the suction hole 60 formed in the side wall 603 of the housing 601. The suction force of the pump 36 causes the air in the sixth pressure room 68 to be discharged to the exterior. The air discharged from the sixth pressure room 68 causes the air in the second mist collection unit 600 to flow to the exhaust air hole 69. As a result, the exterior air is sucked from the suction hole 40 into the second mist collection unit 600.

The air sucked from the suction hole 40 is allowed to pass through the suction flow path 43 and is partially blown to the mist trap face 64. The blown mist is partially attached to the second mist trap face 64 downwardly protruding from the side wall 603 of the housing 601 in an inclined manner. When an increased amount of the mist is attached to the second mist trap face 64, the mist turns into liquid (waste liquid) and the liquid falls in drops from the mist trap face 64 and is retained in the waste liquid retention part 62. The second mist collection unit 600 has the housing 601 having the side wall 603 including a waste liquid discharge hole 61. The waste liquid discharge hole 61 is connected to the pump 39 via the pipe 31. The pump 39 is driven at a predetermined timing to thereby allow the waste liquid and exhaust air retained in the waste liquid retention part 62 to be discharged from the waste liquid retention part 62. The waste liquid and exhaust air discharged from the waste liquid retention part 62 are cleaned by the cleaning mechanism 37 and is subsequently allowed to pass through the valve 38 and is discharged to the exterior from the pump 39.

The third mist collection unit 700 shown in FIG. 4C is separated by a separation wall 705 for halving the interior in the front-and-rear direction (the left-and-right direction in FIG. 4C) to a structure section 700A for sucking air including mist and a structure section 700B for blowing air current.

The structure section 700A includes a suction flow path 73 communicating with a suction hole 70, a waste liquid retention part 72, the first pressure room 76, and the second pressure room 78 for example that are defined and communicate with one another. The second pressure room 78 communicates with the pipe 30 via an exhaust air hole 79. The waste liquid retention part 72 communicates with the pipe 31 via a waste liquid discharge hole 71.

When the air in the second pressure room 78 is discharged to the exterior by the suction force of the pump 36, the air in the structure section 700A is caused to flow to the exhaust air hole 79, thereby causing the exterior air to be sucked from the suction hole 70 into the structure section 700A. The mist included in the air sucked from the suction hole 70 is attached to a mist trap face 74 provided in the suction flow path 73 and is subsequently liquefied and the resultant liquid (waste liquid) falls in drops into the waste liquid retention part 72 and is retained therein. The waste liquid is sucked into the pipe 31 by the driving by the pump 39 and is cleaned by the cleaning mechanism 37 and is subsequently allowed to pass through the valve 38 and is discharged from the pump 39.

The air flowing from the suction hole 70 to the suction flow path 73 is allowed to flow into the second pressure room 78 through the first pressure uniformizing member 75, the first pressure room 76, and the second pressure uniformizing member 77. The air flowing in the second pressure room 78 is discharged from the exhaust air hole 79 to the pipe 30 and is cleaned by the cleaning mechanism 34 and is subsequently discharged to the exterior from the pump 36 through the valve 35.

On the other hand, the structure section 700B includes therein the third and fourth pressure rooms 81 and 83 and a blowoff flow path 85 for example that are defined to communicate one another. The third pressure room 81 is connected to a pipe 29 via an air supply hole 80 formed in the side wall 703 of the housing 701. Thus, the air sent from the pump 33 is allowed to flow from the air supply hole 80 into the third pressure room 81 of the structure section 700B and is blown from the blowoff hole 86 through the third pressure uniformizing member 82, the fourth pressure room 83, the fourth pressure uniformizing member 84, and the blowoff flow path 85. The blown air is blown to the surface of the transfer body 101.

In this embodiment, the first mist collection unit 500 is used as the mist collection units 19 and 20, the second mist collection unit 600 is used as the mist collection units 21 to 25, and the third mist collection unit 700 is used as the mist collection units 26 to 28. However, the first, second, and third mist collection units also may be used in a combination different from that of the above embodiment. For example, in order to collect the mist more securely, the first mist collection unit 500 also can be used as the mist collection units 19 to 23 and the third mist collection unit 700 also can be used as the mist collection units 24 to 28.

Figure 5A:
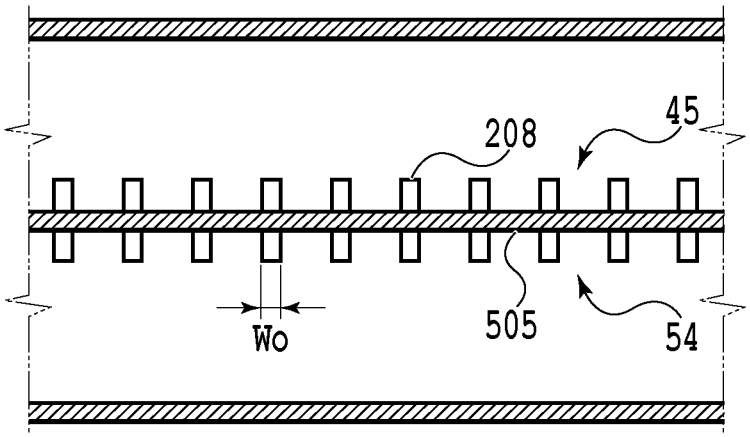
FIGS. 5A and 5B are a vertical cross-sectional views illustrating the first mist collection unit, a cross-sectional view taken along the line VA-VA, and a cross-sectional view taken along the line VB-VB.
Figure 5B:
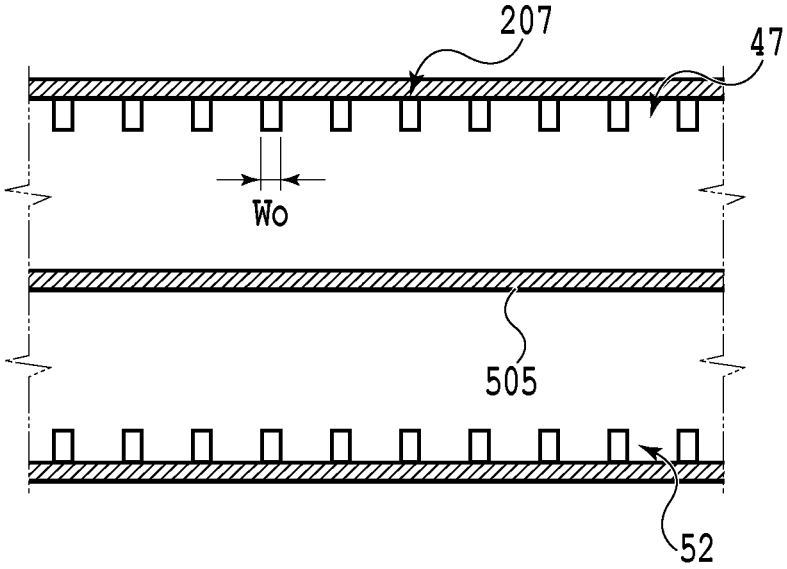

FIGS. 5A and 5B are a cross-sectional view illustrating the configuration of a pressure room and a pressure uniformizing member in the first mist collection unit 500 shown in FIG. 4A. FIG. 5A is a cross-sectional view taken along the line VA-VA of FIG. 4A. FIG. 5B is a cross-sectional view taken along the line VB-VB of FIG. 4A. As described above, the first and second pressure uniformizing members 45 and 47 and the first and second pressure rooms 46 and 48 are used to uniformize the suction flow rate distribution in the first mist collection unit 500 in the longitudinal direction.

The first pressure uniformizing member 45 is provided between one end of a wall for defining the first pressure room 46 and the suction flow path 43 and the separation wall 505. The second pressure uniformizing member is provided between one end of a wall for forming the first pressure room 46 and the second pressure room 48 and the front face of the housing. The first and second pressure uniformizing members are both a member forming a space extending in the longitudinal direction. The upper face and the lower face forming the space include a plurality of penetration holes 207 and 208 as shown in FIGS. 5A and 5B. In this embodiment, the penetration holes 207 and 208 have an opening width Wo of about 1 mm. Air having passed through these penetration holes 207 and 208 is dispersed in the longitudinal direction to thereby uniformize the pressure of the air passing therethrough.

The first and second pressure rooms form the spaces extending in the longitudinal direction. Thus, the air flowing in the respective spaces is uniformly dispersed in the longitudinal direction, thereby similarly uniformizing the air pressure.

As described above, the first and second pressure uniformizing members and the first and second pressure rooms in the first mist collection unit have been described. However, the configuration and action of the first and second pressure uniformizing members are similar to those of the third pressure uniformizing member 52, the fourth pressure uniformizing member 54, and other pressure uniformizing members. The actions of the first and second pressure rooms are similar to those of other pressure rooms.

The numbers of the pressure rooms and the pressure uniformizing members provided in the mist collection unit are not always limited to a plural number. Specifically, when a single pressure uniformizing member or a single pressure room are used to uniformize the suction flow rate distribution of the suction hole in the longitudinal direction, a plurality of pressure uniformizing members and pressure rooms are not required. On the contrary, a pressure uniformizing member and a pressure room also may be added in order to further uniformize the suction flow rate distribution in the longitudinal direction.

Next, the following section will describe the relation between the position of a mist collection unit and the waste liquid retention part, the suction hole, and the blowoff hole provided in the mist collection unit. As shown in FIG. 4A, the first mist collection unit 500 and the third mist collection unit 700 are arranged so that the waste liquid retention parts 42 and 72, the suction holes 40 and 70, and the blowoff holes 56 and 86 are provided at inverted positions in the transfer body 101 in the rotation direction D1, respectively. In this embodiment, the first mist collection unit 500 is used to the mist collection units 19 and 20 and the third mist collection unit 700 is used to the mist collection units 26, 27, and 28 due to the following reason.

Figure 6:
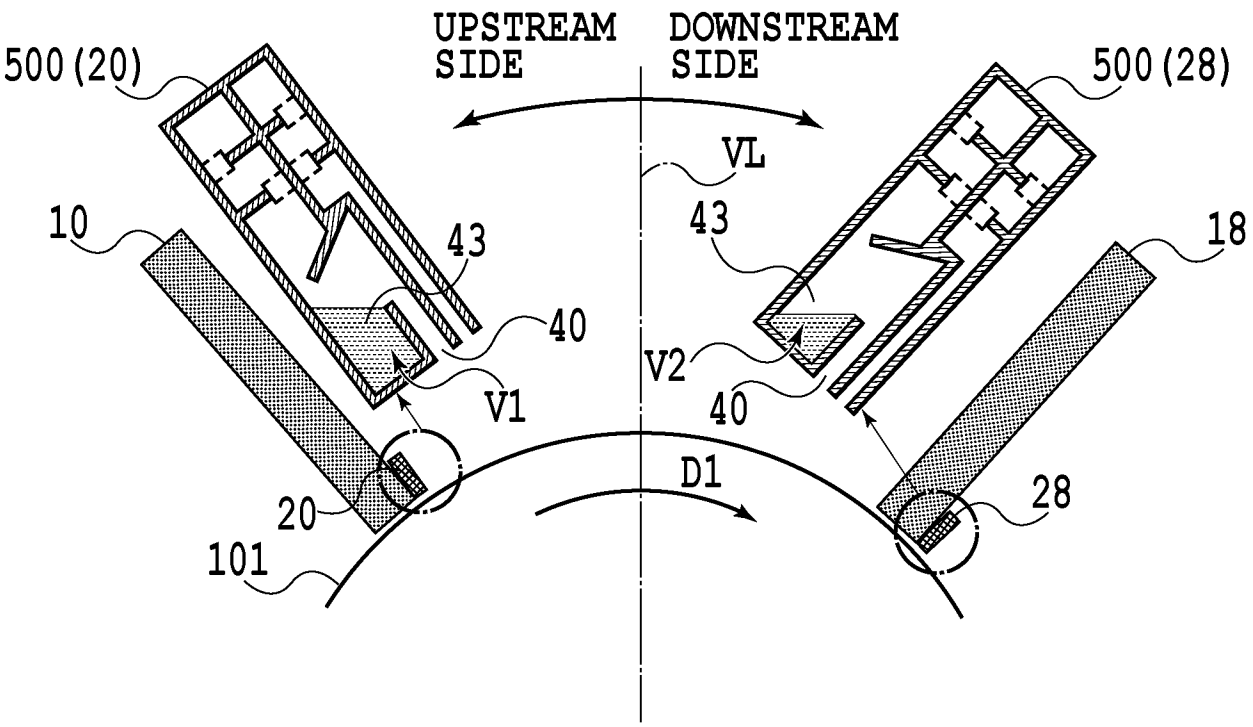
FIG. 6 illustrates how the first mist collection unit is provided and the enlarged vertical section thereof.

FIG. 6 shows an example in which the first mist collection unit 500 is used as the mist collection units 20 and 28. In FIG. 6, parts V1 and V2 shown by diagonal lines show the volume of the waste liquid that can be retained in the waste liquid retention part 42 of the respective mist collection units 20 and 28. It can be seen that the comparison between V1 and V2 shows that V1 has a higher volume than V2. When assuming that the perpendicular line VL that is perpendicular to the floor on which the apparatus is provided and that passes through the rotation center in the upper half of the transfer body 101 is determined as a reference, a direction opposite to the rotation direction of the transfer body 101 is defined as the upstream side and a direction in the same direction as this reference direction is defined as the downstream side. Since the printing apparatus is provided on a horizontal or substantially-horizontal floor, the perpendicular line VL is the same as the vertical direction (gravitational force direction).

At the upstream side, when the upstream side (front side) of the suction hole 40 has the waste liquid retention part 42, a higher amount of mist can be retained. Thus, the mist collection units 19 and 20 disposed at the upstream side than the reference use the first mist collection unit 500. This can consequently reduce the number of operations to discharge the waste liquid retained in the waste liquid retention part 42 and can suppress the waste liquid from flooding from the waste liquid retention part 42 to flow from the suction hole 40 onto the transfer body 101.

Figure 7:
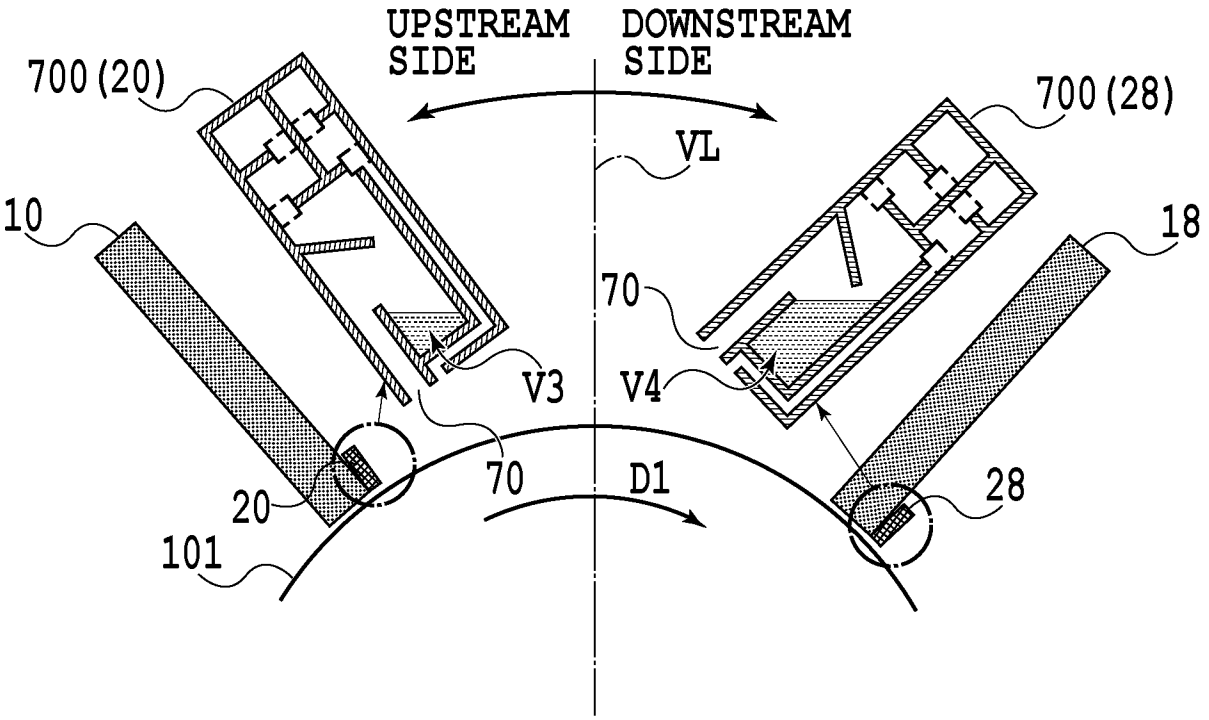
FIG. 7 illustrates how the third mist collection unit is provided and the enlarged vertical section thereof.

FIG. 7 is a cross-sectional view illustrating an example in which the third mist collection unit 700 is used as the mist collection units 20 and 28. In FIG. 7, the parts V3 and V4 shown by the diagonal lines show the volume of the waste liquid that can be retained in the respective waste liquid retention parts 72 of the mist collection units 20 and 28. It can be seen that the comparison between V3 and V4 shows that V3 has a lower volume than V4. Specifically, if the downstream side has the waste liquid retention part 72 at the downstream side (rear side) of the suction hole (suction hole) 70, a higher amount of waste liquid can be retained. Thus, the mist collection units 26, 27, and 28 provided at the downstream side than the reference use the third mist collection unit 700. This can consequently reduce the number of the operations to discharge the waste liquid retained in the waste liquid retention part 72 and can suppress the waste liquid from flooding from the waste liquid retention part 72 to flow from the suction hole 70 onto the transfer body 101.

Figure 8:
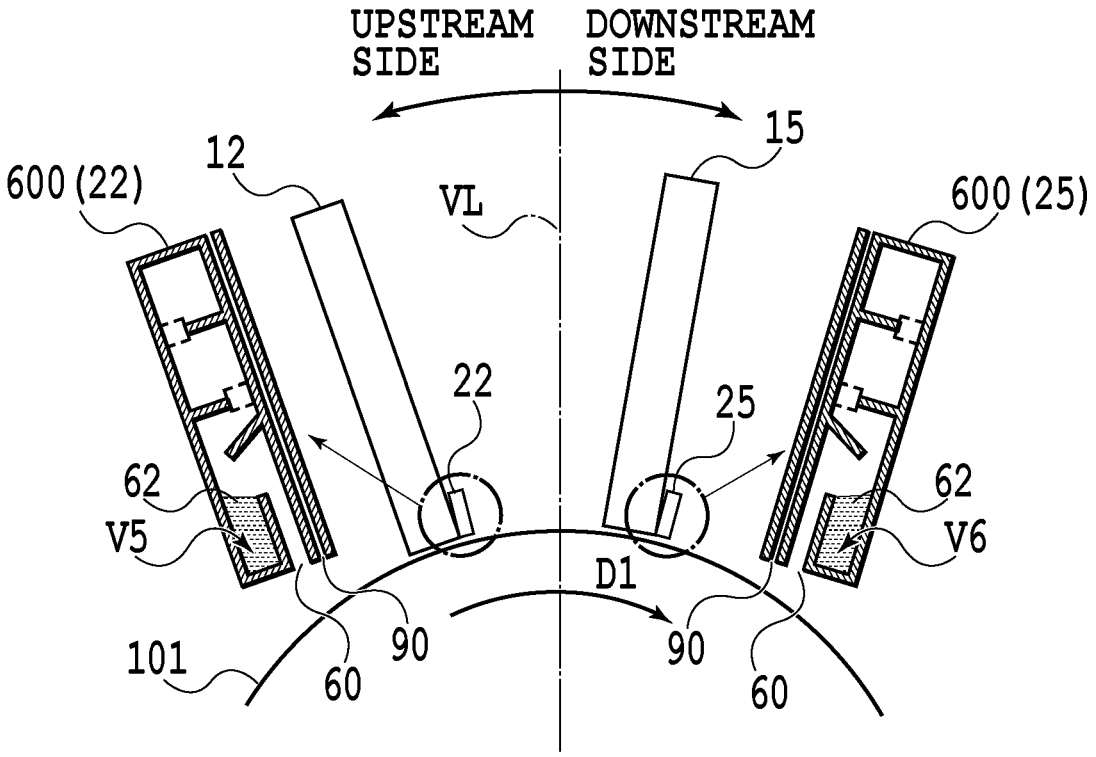
FIG. 8 illustrates how the second mist collection unit is provided and the enlarged vertical section thereof.

On the other hand, FIG. 8 is a cross-sectional view illustrating an example in which the mist collection units 22 and 25 use the second mist collection unit 600. In the FIG. 8, the parts V5 and V6 shown by the diagonal lines show the volume of the waste liquid that can be retained in the waste liquid retention parts 62 of the second mist collection units 600 of the mist collection units 22 and 25, respectively. In this example, as in the example shown in FIG. 6, the second mist collection unit 600 is provided so that the upstream side than the reference has the waste liquid retention part 62 at the upstream side (front side) of the suction hole 60. At the downstream side, as in the example shown in FIG. 7, the second mist collection unit 600 is disposed so that the downstream side (rear side) of the suction hole 60 has the waste liquid retention part 62. This can consequently allow a sufficient volume of the waste liquid to be retained in the waste liquid retention part 62. Thus, the second mist collection unit 600 also can have a reduced number of operations to discharge the waste liquid retained in the waste liquid retention part 62 and can suppress the waste liquid from flooding from the waste liquid retention part 62 to flow from the suction hole 60 onto the transfer body 101.

The first, second, and third mist collection units 500, 600, and 700 desirably have a gap to metal fittings to retain the ejection heads 10 to 18 or the ejection heads 10 to 18. Such a gap allows air current to flow through the gap, thus suppressing mist from being attached to the face opposed to the mist collection unit to the transfer body 101 and the transfer body 101. The provision of a gap 90 between an ejection head or a member for retaining the ejection head and the second mist collection unit 600 is particularly effective. Specifically, although the second mist collection unit 600 does not include a blowoff hole, the gap 90 can function as a blowoff hole. Thus, air is smoothly sucked through the suction hole 60 and the air current blown from the gap 90 is allowed to reach the transfer body 101 to substantially function as a blowing air current. Thus, the mist can be collected efficiently.

In this embodiment, the suction discharge mechanism 300 can be used to clean the interiors of the mist collection units 500, 600, and 700 used for the mist collection units 19 to 28. In order to clean the mist collection unit 500, the switching valve 231 provided at the middle of the pipe 30 is switched to provide the communication between the washing liquid injection mechanism 230 and the mist collection unit 500 and to block the communication between the mist collection unit 500 and the cleaning mechanism 34. Thereafter, the washing liquid is sent from the washing liquid injection mechanism 230 to allow the washing liquid to flow from the exhaust air hole 49 into the structure section 500A of the mist collection unit 500. The washing liquid flows into the suction flow path 43 and the waste liquid retention part 42 via the second pressure room 48 and the first pressure room 46 and is finally discharged through the discharge hole 41. As a result, the mist and dust adhered in a fixed manner in the structure section 500A is washed off by the washing liquid to thereby maintain a favorable air flowability in the structure section 500A. As described above, a method of washing the interior of the first mist collection unit has been described. However, the same washing also can be performed in the second and third mist collection units 600 and 700.

Another configuration also can be used in which the cleaning of a mist collection unit and the mist collection are simultaneously performed during the driving of the printing apparatus 100. This is achieved by a configuration in which the upper side of the mist collection unit has an exclusive hole for injecting cleaning liquid through which washing liquid can be appropriately injected. The washing of the mist collection unit causes the washing liquid to be collected in the waste liquid retention parts 42, 62, and 72. Thus, washing liquid collected in the interior is desirably sucked through discharge openings 41, 61, and 71 by driving the pump 39 after the washing operation or simultaneous with the washing operation. However, even after the discharge operation, the washing liquid attached to the mist trap faces 44, 64, and 74 and the inner faces of the mist collection units 500, 600, and 700 may flow down. However, this washing liquid is retained in the waste liquid retention parts 42, 62, and 72 and is mixed with the mist liquid to turn into the waste liquid. Thus, during the printing operation, as in the above-described mist liquid, the washing liquid is prevented from flowing from the suction holes 40, 60, and 70 onto the transfer body 101. Then, by driving the pump 39 at a predetermined timing, the washing liquid and the mist liquid can be discharged from the waste liquid retention parts 42, 62, and 72.

The following section will show specific examples of the blowoff air currents of the respective mist collection units, the suction air current speed, the blowoff hole, and the width of the suction hole. The suction hole 40 of the first mist collection unit 500, the suction hole 60 of the second mist collection unit 600, and the suction hole 70 of the third mist collection unit 700 preferably have a width of about 3 to 5 mm, respectively. The blowoff hole 56 of the first mist collection unit 500 and the blowoff hole 86 of the third mist collection unit 700 preferably have a width of about 0.5 to 2 mm, respectively. The gap 90 of the second mist collection unit 600 preferably has a width of 0.5 mm or more. Air is preferably sucked through the suction hole 40 of the first mist collection unit 500, the suction hole 60 of the second mist collection unit 600, and the suction hole 70 of the third mist collection unit 700 at a speed of about 0.3 to 1.0 m/s, respectively. Air is blown from the blowoff hole 56 of the first mist collection unit 500 and the blowoff hole 86 of the third mist collection unit 700 preferably at a flow rate of about 0.5 to 1.0 m/s and more preferably at a flow rate of 0.5 to 2.0 m/s.

Figure 12:
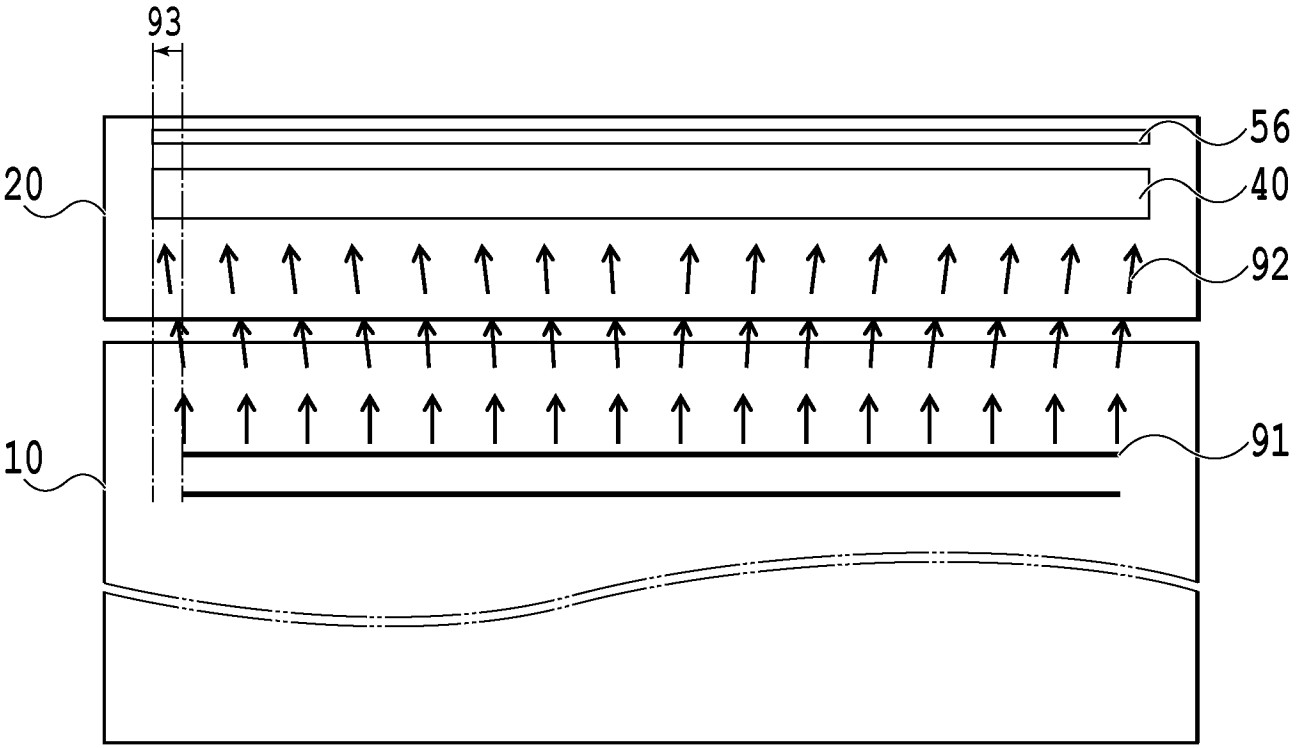
FIG. 12 is a plan view illustrating the reaction liquid ejection head and the mist collection unit seen from the transfer body side.

FIG. 12 is a plan view illustrating the ejection head 10 and the mist collection units 20 seen from the transfer body 101. The reaction liquid mist caused by the ejection of the reaction liquid from the ejection port array 91 of the ejection head 10 is allowed, as shown by the arrow 92, to move to the mist collection units 20 while expanding in the length direction of the ejection port array 91. Thus, in order to collect the mist completely, the blowoff hole 56 and the suction hole 40 of the mist collection units 20 must have a length longer than the length of the ejection port array 91. The present inventor has confirmed that a favorable mist collection is performed by setting a difference between the length of the blowoff hole 56 and the suction hole 40 and the length of the ejection port array 91 to a value 20 times or more longer than the distance between the ejection head 10 and the transfer body 101.

Among the ejection heads 10 to 18, the mist collection units 19 and 20 provided at the front and rear sides of the pre-processing liquid ejection head 10 for which the mist must be collected completely in particular have the blowoff hole 56 and the suction hole 40 formed to be longer than the ejection port array. The distance between the ejection heads 10 to 18 and the transfer body 101 is about 1 mm or less at the narrowest portion. Thus, the difference 93 between the length of the ejection port array 91 and the length of the blowoff hole 56 and the suction hole 40 was set to 20 mm at one side. Other ejection heads and mist collection units are desirably formed so that the ejection port array similarly has a length shorter than the length of the blowoff hole 56 and the suction hole 40.

As described above, this embodiment can suppress the mist or washing liquid for example attached to the interior of the mist collection unit from flowing off from the suction hole, thereby preventing an image formed on the transfer body from being contaminated. Furthermore, the waste liquid collected at one place (or the waste liquid retention part) provides an easy discharge of the waste liquid, thereby realizing the simpler washing operation.

Also according to this embodiment, the first or third mist collection unit 500 or 700 is provided at the front and rear sides of the reaction liquid ejection heads 10 and 18 for which an influence by the mist leakage cannot be ignored and the ink ejection head 17 having a possibility of an increased mist generation amount. This can consequently suppress the reaction liquid mist and the ink mist from being attached to the ejection head or the internal mechanism of the printing apparatus for example to thereby reduce the ejection head having an ejection defect and the influence on the internal mechanism of the printing apparatus. Furthermore, the first and third mist collection units 500 and 700 generating both of the suction air current and the blowoff air current are provided only at the front and rear sides of a specific ejection head and a relatively-small second mist collection unit 600 was provided for other ejection heads. This can provide an appropriate mist collection by a compact configuration while reducing the total air volume required for the mist collection.

To generalize the configuration of this embodiment, the first mist collection unit included in a plurality of mist collection units is provided to be inclined to the upstream side in the medium conveyance direction with respect to the perpendicular line perpendicular to the floor. Furthermore, the first mist collection unit includes a liquid retention part provided at the upstream side than the suction hole through which mist is sucked. Furthermore, the second mist collection unit different from the first mist collection unit is provided to be inclined to the downstream side in the conveyance direction with regard to the perpendicular line. The second mist collection unit includes a waste liquid retention part provided at the downstream side than the suction hole. This configuration allows the retention parts in the respective plurality of mist collection units to retain liquid by a sufficient capacity, thus suppressing the liquid caused by liquefied mist from dropping down.

When the configuration of this embodiment is generalized from another viewpoint, a plurality of ejection heads include an ink ejection head for ejecting ink and a reaction liquid ejection head for ejecting reaction liquid reacting with the ink. At least one of the most upstream and the most downstream in the medium conveyance direction has a reaction liquid ejection head. The upstream side and the downstream side of the reaction liquid ejection head have a mist collection unit including an air blowoff hole and an air suction hole provided to be adjacent to each other at the bottom of the housing. This configuration allows the reaction liquid mist to be efficiently collected just after the generation thereof, thus suppressing the reaction liquid mist from being attached to the periphery. If the reaction liquid mist is mixed with the ink mist, the resultant mixture tends to be adhered as tough dirt in a fixed manner. By collecting the mist as in this configuration so as to shield the upstream and downstream of the reaction liquid ejection head, the mist is suppressed from flowing from the reaction liquid ejection head to an ink ejection head adjacent to the reaction liquid ejection head, thus suppressing tough dirt from being adhered in a fixed manner to the neighborhood of the head ejection port.

(Second Embodiment)

Figure 9C:
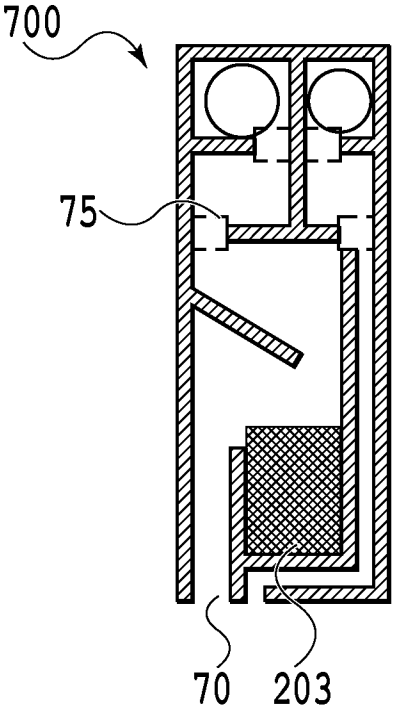
FIGS. 9A to 9C are vertical cross-sectional views illustrating the configuration of the mist collection unit in the second embodiment.
Figure 9B:
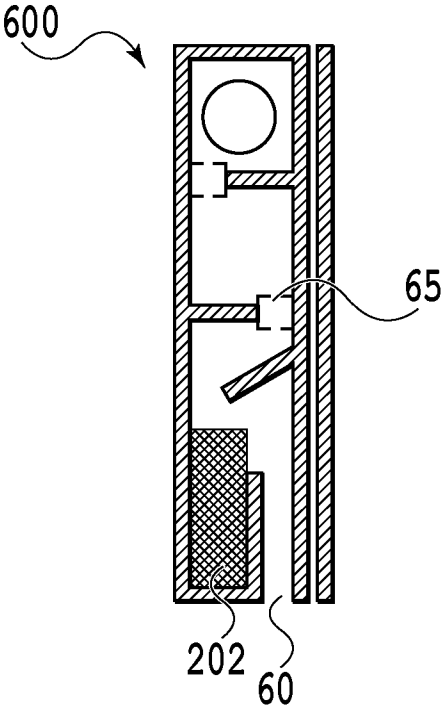
Figure 9A:
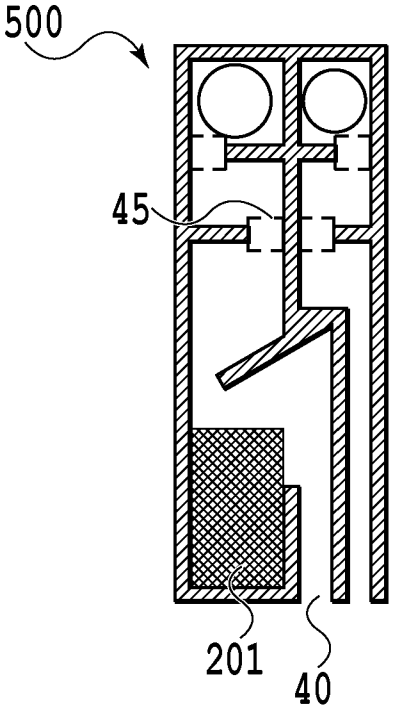

FIGS. 9A to 9C are a cross-sectional view illustrating the second embodiment. FIG. 9A shows the first mist collection unit 500, FIG. 9B shows the second mist collection unit 600, and FIG. 9C shows the third mist collection unit 700, respectively. The waste liquid retention parts (retention parts) 42, 62, and 72 of the first, second, and third mist collection units 500, 600, and 700 store therein porous bodies 201, 202, and 203 functioning as an ink absorber. This allows the waste liquid in the waste liquid retention parts 42, 62, and 72 to be absorbed and retained by the porous bodies, thus suppressing the waste liquid from leaking to the suction holes 40, 60, and 70. Also according to this embodiment, the volumes of the porous bodies determine the amount of the waste liquid that can be retained. Thus, a fixed amount of the waste liquid depending on the volume of the porous bodies can be retained regardless of a position at which the mist collection unit is provided. The porous bodies may be provided in a range expanded to the positions abutted to the first pressure uniformizing member 45, the fifth pressure uniformizing member 65, and the seventh pressure uniformizing member 75. Since the porous bodies function as a fluid resistance element, the existence of the porous bodies can provide the more uniformized flow rate distribution of the blowoff air current and the suction air current.

(Third Embodiment)

Figure 10:
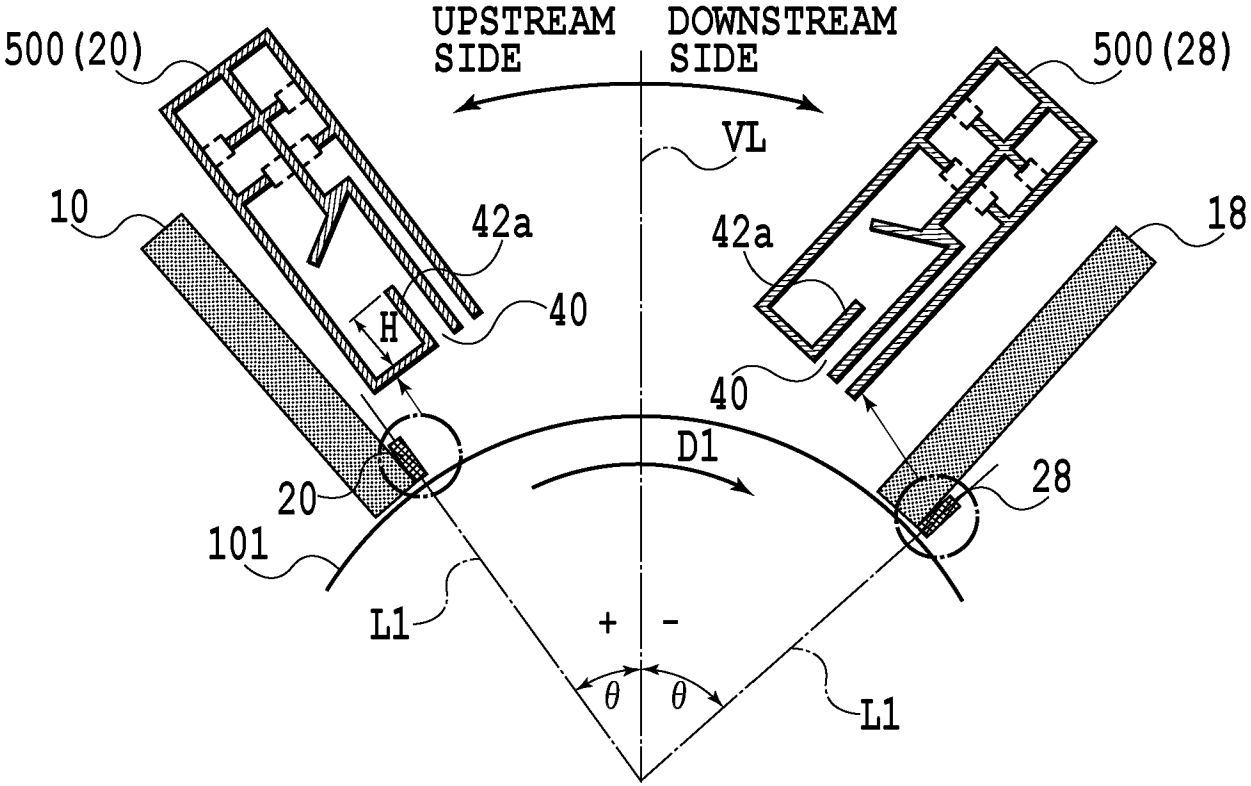
FIG. 10 illustrates a positional relation between the first mist collection unit and a transfer body in the third embodiment and the enlarged vertical section thereof.

FIG. 10 is a cross-sectional view illustrating the positional relation between the first mist collection unit 500 and the transfer body. With regard to the perpendicular line VL passing through the rotation center of the transfer body 101, an angle formed by the center lines L1 of the transfer body 101 and the mist collection units 20 and 28, respectively, and the perpendicular line VL is assumed as θ. Based on the perpendicular line VL passing through the rotation center of the transfer body 101 as a reference, a direction opposite to the rotation direction of the transfer body 101 is assumed as the upstream side and the same direction as this direction is assumed as the downstream side. An angle formed by the center line L1 positioned at the upstream side and the perpendicular line VL is assumed as a positive angle. An angle formed by the center line L1 positioned at the downstream side and the perpendicular line VL is assumed as a negative angle. The length from the lower end to the upper end of a side wall 42*a* forming the waste liquid retention part 42 in the mist collection unit is assumed as H.

The side wall 42*a* extends in a direction orthogonal to the bottom wall 502 of the first mist collection unit 500. By increasing the side wall length H in accordance with the increase of the absolute value of the angle θ, a higher amount of the waste liquid can be retained in the waste liquid retention part 42. Alternatively, if −θ has a higher absolute value, H can be increased to thereby increase the amount of the mist that can be retained in the waste liquid retention part 42. Specifically, the relation between θ and H can be represented as shown below when α is assumed as a coefficient related to the retention volume.

$$L=\alpha\times\tan|\theta| \quad \text{(formula 1)}$$

Although the first mist collection unit 500 was shown in FIG. 10, FIG. 10 also applies to the second and third mist collection units 600 and 700. Specifically, the side walls 62*a* and 72*a* (see FIGS. 4B and 4C) extending in a direction orthogonal to the bottom walls 602 and 702 of the waste liquid retention parts 62 and 72 may have a length different depending on the angle. This can allow an optimal amount of the mist to be retained in the waste liquid retention part.

(Fourth Embodiment)

Figure 11:
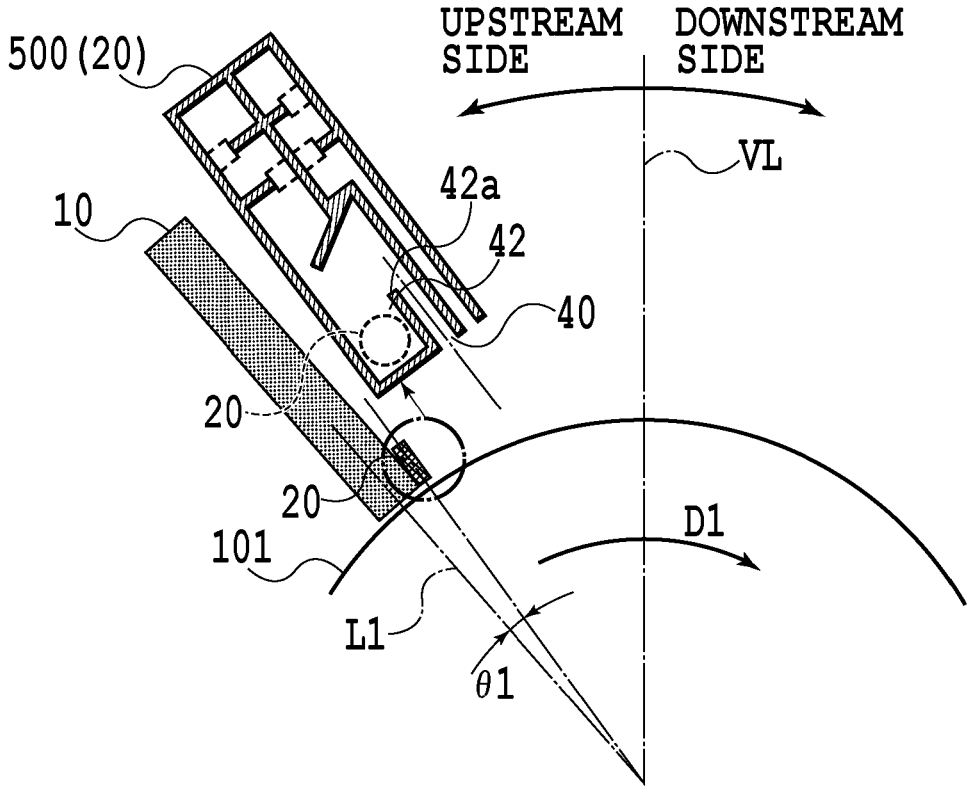
FIG. 11 is a positional relation among the first mist collection unit, the transfer body, and a reaction liquid ejection head in the fourth embodiment and the enlarged vertical section thereof.

FIG. 11 is a cross-sectional view illustrating an example in which the first mist collection unit 500 is used as the mist collection units 20 and shows the positional relation among the first mist collection unit 500, the transfer body 101, and the ejection head 10. An angle formed by the straight line (center line) L1 connecting the center of the ejection head 10 positioned at the upstream side of the mist collection units 20 to the rotation center of the transfer body 101 and the straight line L2 connecting the center of the suction hole 40 of mist collection units 20 to the rotation center of the transfer body 101 is assumed as θ1. In order to collect mist before the mist generated from the ejection head 10 is diffused to the internal mechanism of the printing apparatus, θ1 is desirably minimized. Specifically, it is desired that the center of the ejection head 10 is maximally closer to the center of the suction hole 40 of the mist collection units 20. θ1 shows the position at which the first mist collection unit 500 is provided and is set, as described for the second and third embodiments, as to achieve the following relation.

θ1 at the upstream side>θ1 at the downstream side (formula 2)

This allows a higher amount of the waste liquid to be retained in the waste liquid retention part 42. The retention amount of the waste liquid set for the mist collection units 20 is determined depending on a method of discharging the mist from the waste liquid retention part 42. For example, in the case of the method of always discharging the waste liquid from waste liquid discharge hole 41, the liquid retention volume capacity of the waste liquid retention part 42 can be reduced to thereby reduce □1. In the case of a method of intermittently discharging the waste liquid from waste liquid discharge hole 41, waste liquid consisting of mist for example is collected in the waste liquid retention part 42 between the discharge operation and the discharge operation. Thus, the waste liquid retention part 42 must secure a certain liquid retention volume capacity. Specifically, the angle θ1 must be increased to a certain level. The first mist collection unit 500 has been described in the above section. However, the angle θ1 for the second and third mist collection units 600 and 700 may be similar determined appropriately depending on the positions thereof and a method of discharging the waste liquid.

(Fifth Embodiment)

Figure 13:
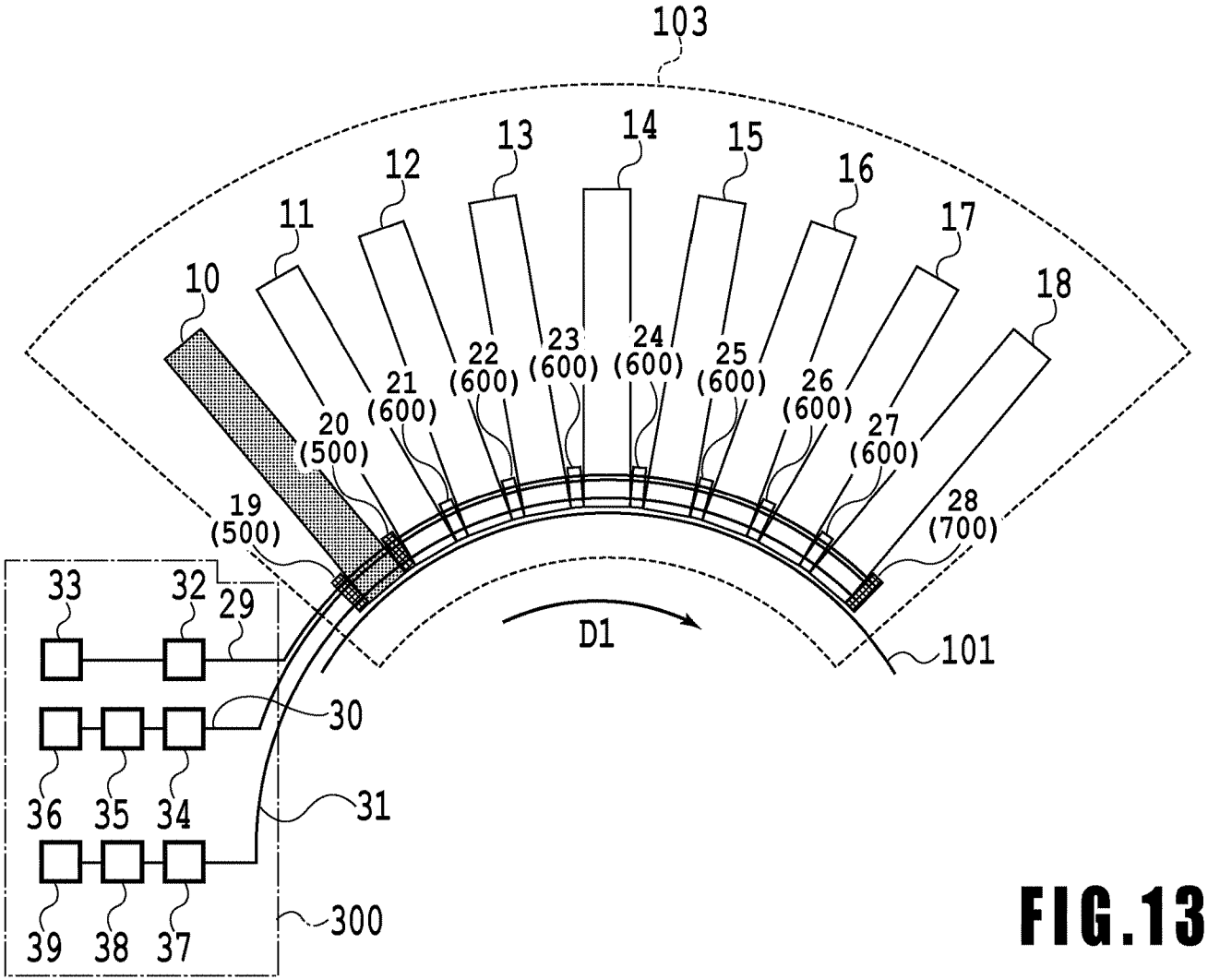
FIG. 13 is a vertical cross-sectional view illustrating a configuration of the mist collection unit in the fifth embodiment.

FIG. 13 is a schematic view illustrating the internal configuration of the unit printing units 103 in the fifth embodiment and the configuration of the mist collection apparatus. As in the first embodiment, the unit printing units 103 includes nine ejection heads 10 to 18 disposed to be opposed to one another so as to have a predetermined interval from the surface of the transfer body 101 (about 1 mm or less at the narrowest portion). The ejection head 10 is a pre-processing liquid ejection head to eject pre-processing liquid. The ejection heads 11 to 18 are an ink ejection head for ejecting ink. However, in this fifth embodiment, such a configuration is used that omits a washing liquid injection mechanism 230 and the switching valve 231 (see FIG. 2) shown in the first embodiment.

The mist collection units 19 to 28 are provided just before the ejection head 10 and just after the ejection head 18 and among the respective ejection heads 10 to 18. The mist collection units 19 and 20 provided at the front and rear sides of the pre-processing liquid ejection head 10 use the first mist collection unit 500 to generate the blowoff air current and the suction air current. Since the ejection head 18 is a tail end head of the unit printing units 103, the mist leakage therefrom causes a risk in which the mist floats in the inkjet printing apparatus and is attached to various portions of the printing apparatus. To prevent this, the mist collection units 28 disposed at the rear side of the ejection head 18 uses the third mist collection unit 700 to generate the blowoff air current and the suction air current. Other mist collection units 21 to 27 use the second mist collection unit 600 to use a sucked air current. The other configurations are the same as those of the first embodiment.

According to the above configuration, the first and third mist collection units 500 and 700 for generating the blowoff air current and the suction air current were provided at the front and rear sides of the ejection heads 10 and 18 for which the influence by the mist leakage cannot be ignored and the rear side of the ejection head 18. This can provide an appropriate mist collection by a compact configuration while reducing the total air volume.

(Sixth Embodiment)

Figure 14:
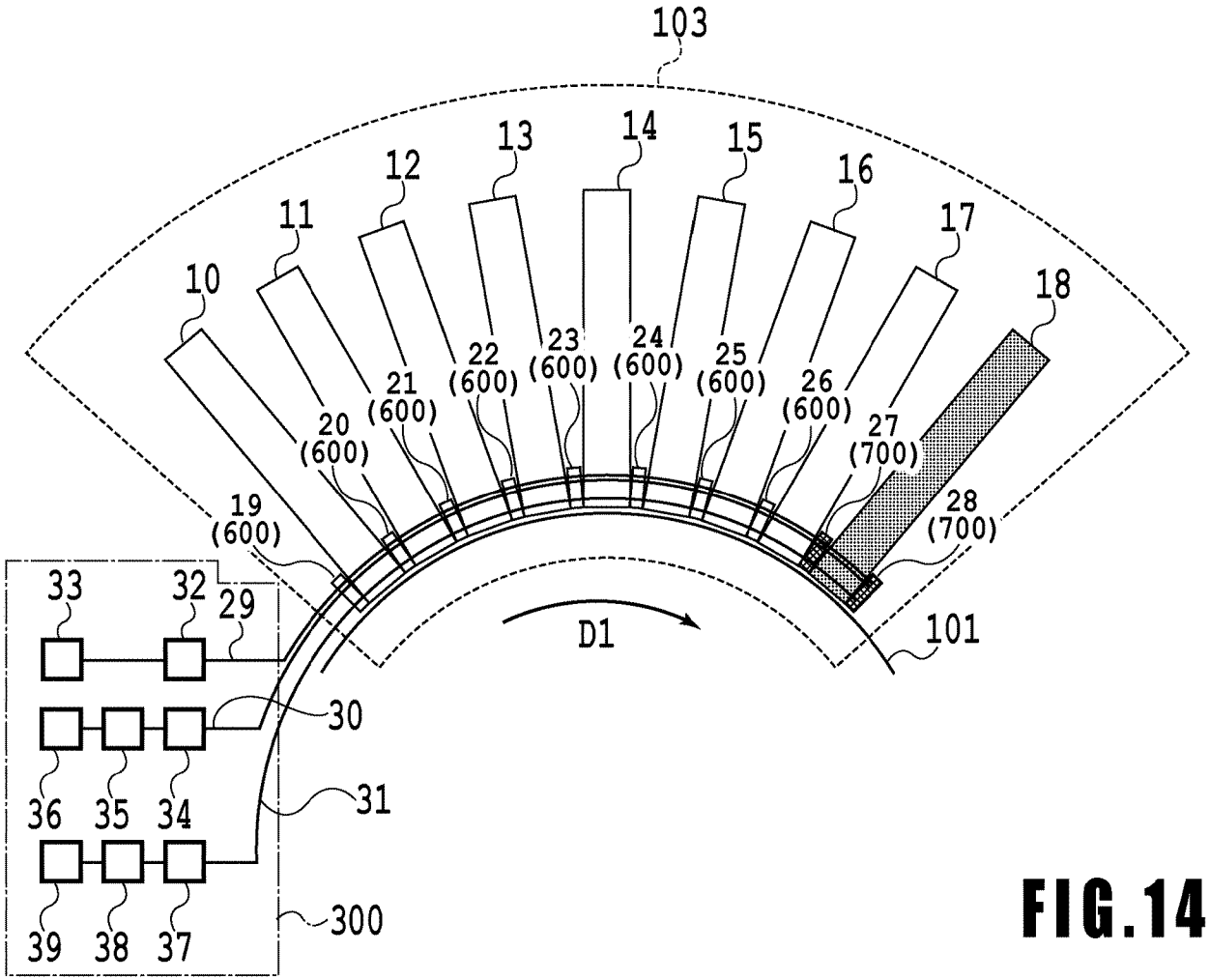
FIG. 14 is a vertical cross-sectional view illustrating the configuration of the mist collection unit in the sixth embodiment.

FIG. 14 is a schematic view illustrating the internal configuration of the unit printing units 103 in the sixth embodiment and the configuration of the mist collection apparatus. The same or similar units as those of the first embodiment are denoted with the same reference numerals.

This embodiment is similar to the first embodiment in that nine ejection heads 10 to 18 are disposed along the surface of the transfer body 101. The ejection heads 10 to 17 are an ink ejection head. The ejection head 18 is a post processing liquid ejection head to eject post processing liquid. The mist collection units 27 and 28 provided at the front and rear sides of the post processing liquid ejection head 18 have the third mist collection unit 700 highly effective to suppress the mist leakage. The mist collection units 19 to 26 use the small second mist collection unit 600 that uses the suction air current only.

By the above-described configuration, the third mist collection units 700 for generating the blowoff air current and the suction air current were used at the front and rear sides of the ejection head 18 for which the influence by the mist leakage cannot be ignored. This can provide an appropriate mist collection by a compact configuration while reducing the total air volume.

(Seventh Embodiment)

In the above embodiment, as an inkjet printing apparatus according to the present invention, a printing apparatus has been described in which an image formed on the periphery face of the cylindrical transfer body 101 is transferred onto the sheet S for a printing operation. However, the present invention is not limited to the use of a cylinder drum-like transfer body. For example, the invention also can use a transfer-type printing apparatus to form an image on a belt-like rotation transfer body and a direct-type printing apparatus to apply ink to a moving sheet (print medium) to directly form an image for example.

Figure 15:
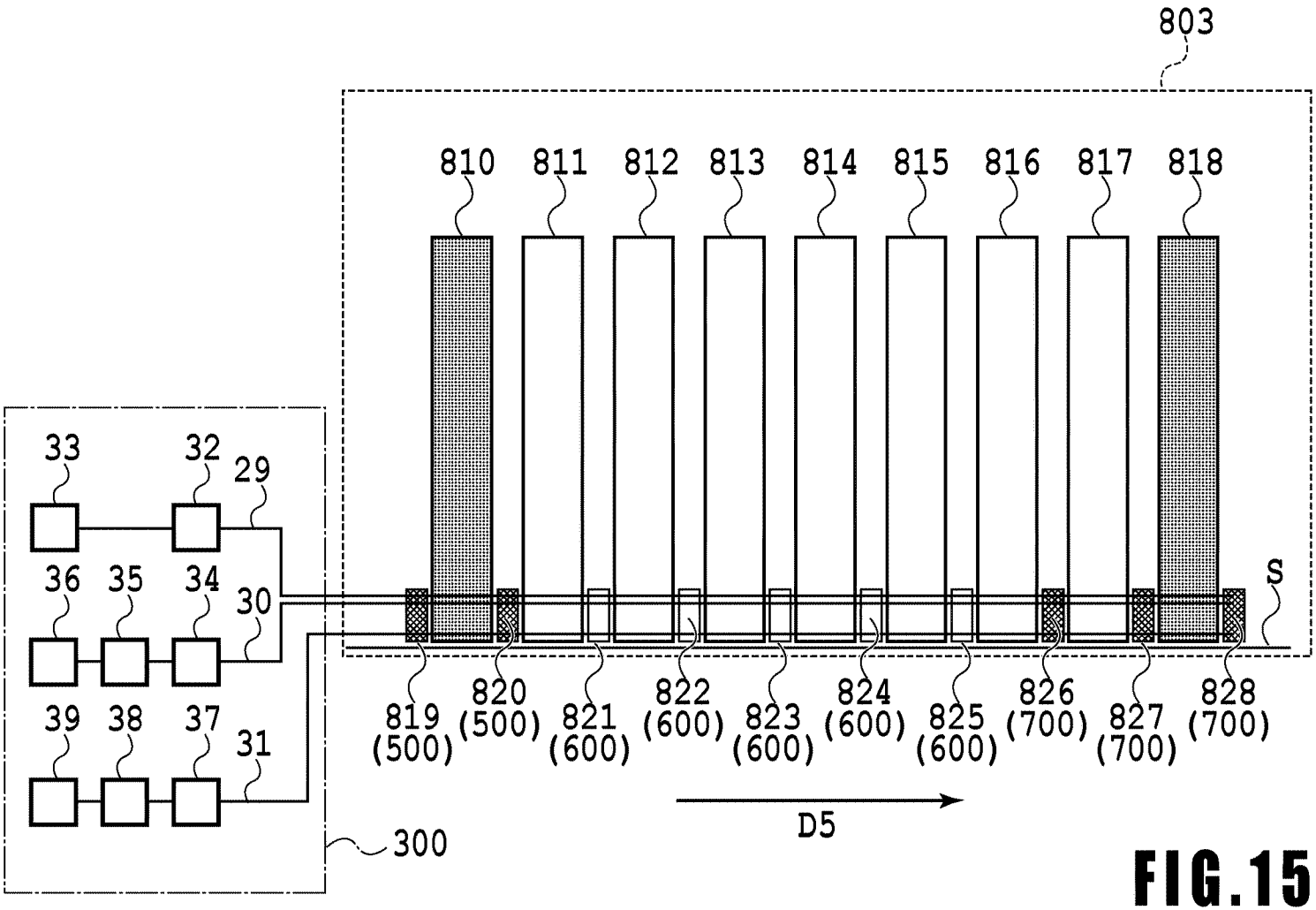
FIG. 15 is a vertical cross-sectional view illustrating the configuration of the mist collection unit in the seventh embodiment.

FIG. 15 is a schematic view illustrating the direct-type inkjet printing apparatus to allow the unit printing unit 803 to directly form an image on the sheet S (print medium) moving along the plane direction D5. The printing unit 803 includes ejection heads 810 to 818 provided along a plane parallel to the sheet S moving on the plane. The ejection head 810 provided at the most upstream position in the conveyance direction D5 of the sheet S is a pre-processing ejection liquid head. The ejection head 818 provided at the most downstream position of the sheet S is a post processing liquid head. The seven ejection heads 811 to 817 provided between the pre-processing liquid ejection head 810 and the post processing liquid ejection head 818 are an ink ejection head for ejecting ink. The sheet S is not limited to an embodiment in which the sheet S is moved along a plane and also may be moved along a curved surface.

The mist collection units 819 to 828 are disposed along the conveyance direction D5 of the sheet S in series so as to be positioned at the front and rear sides of the respective ejection heads. The mist collection units 819 and 820 provided at the front and rear sides of the pre-processing liquid ejection head 810 use the first mist collection unit 500 using the blowoff air current and the suction air current. The post processing liquid ejection head 818 and the mist collection units 826, 827 and 828 disposed at the front and rear sides of the ink ejection head 817 for which the ejection of a large amount of mist is expected use the mist collection unit 700 that uses the blowoff air current and the suction air current. Mist collection units disposed among other ink ejection heads 811 to 816 use the second mist collection unit 600 as in the first embodiment. In the case where the ejection head and the mist collection unit are provided on a plane as in this embodiment, any of two types of mist collection unit (the first mist collection unit 500, the third mist collection unit 700) may be used as a mist collection unit using the blowoff air current and the suction air current. Specifically, the mist collection units 819 and 820 may use one type of mist collection unit (the third mist collection unit 700) while the mist collection units 826, 827, and 828 may use another type of mist collection unit (the first mist collection unit 500).

As described above, even in the case of a printing apparatus to directly print an image on a sheet-like print medium, the mist collection unit using the suction air current and the blowout air currents are used only at the front and rear sides of an ejection head for which the influence by the mist leakage cannot be ignored, thereby suppressing the flow of the mist. At the same time, the printing apparatus can have a compact configuration and the total air volume for collecting mist also can be suppressed.

(Other Embodiments)

In the above respective embodiments, the waste liquid retention parts 42, 62, and 72 of the first, second, and third mist collection units 500, 600, and 700 may have the liquid retention volume capacities set depending on the type of liquid ejected from ejection heads provided to be adjacent to the respective mist collection units. For example, mist collection units provided at the front and rear sides of the pre-processing liquid ejection head or the post processing liquid ejection head or the front and rear sides of an ejection head generating a large amount of mist are set to have a waste liquid retention part having a higher volume than that of a mist collection unit provided between other ink ejection heads. This can consequently suppress the waste liquid from flowing down from the air suction hole.

In the above embodiment, a printing apparatus has been described in which an image formed on the periphery face of the cylindrical transfer body 101 is transferred onto the sheet S for a printing operation. However, the present invention is not limited to a printing apparatus using a cylinder drum-like transfer body. For example, the invention also can be used for a printing apparatus using a transfer method to form an image on a belt-like rotation transfer body and a direct-type printing apparatus to apply ink to a moving sheet (print medium) to directly form an image thereon for example.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications No. 2016-107523, filed May 30, 2016, and No. 2016-107541, filed May 30, 2016, which are hereby incorporated by reference wherein in their entirety.

What is claimed is:

1. A printing apparatus comprising:

a cylindrical transfer body;

a printing unit opposing the cylindrical transfer body and being configured to print an image by ejecting liquid on to the cylindrical transfer body;

a transfer unit configured to transfer the image printed on the cylindrical transfer body to a sheet:

a first mist collection unit configured to collect mist, the mist collection unit opposing the cylindrical transfer body on an upstream side of a vertical line passing through a center of the cylindrical transfer body in a rotation direction of the cylindrical transfer body, the first mist collection unit including (i) a first suction hole which is provided at a position opposing the cylindrical transfer body to suck air and (ii) a first holding portion for holding liquefied liquid sucked from the first suction hole, the first holding portion being located on an upstream side of the first suction hole in the rotation direction;

a second mist collection unit configured to collect mist, the second mist collection unit opposing the cylindrical transfer body on a downstream side of the vertical line, the second mist collection unit including (i) a second suction hole which is provided at a position opposing the cylindrical transfer body to suck air and (ii) a second holding portion for holding liquefied liquid sucked from the second suction hole, the second holding portion being located on a downstream side of the second suction hole in the rotation direction.

2. The printing apparatus according to claim 1, wherein:

the printing unit includes a plurality of ejection heads, the first and second mist collecting units being two of the plurality of mist collection units, and the plurality of ejection heads and the plurality of mist collection units are alternately disposed along the rotation direction of the cylindrical transfer body.

3. The printing apparatus according to claim 1, wherein at least one of the first mist collection unit and the second mist collection unit further includes a housing having a bottom wall and a side wall upwardly protruding from the bottom wall, the side wall having a length H that satisfies the following relation:

$$H=\alpha\tan|\theta|,$$

where θ is an angle formed between the vertical line and a line connecting the center of the cylindrical transfer body and the center of the housing and α is a coefficient related to the liquid volume capacity of the corresponding holding portion.

4. The printing apparatus according to claim 1, wherein the liquid volume capacity of the first holding portion is smaller than the liquid volume capacity of the second holding portion.

5. The printing apparatus according to claim 4, wherein:

the ejection head includes an ink ejection head for ejecting ink and a reaction liquid ejection head for ejecting reaction liquid reacting with the ink, and the first mist collection unit is adjacent to the ink ejection head and is not adjacent to the reaction liquid ejection head and the second mist collection unit is adjacent to the reaction liquid ejection head.

6. The printing apparatus according to claim 1, wherein each of the mist collection units includes a blowoff hole provided adjacent to the suction hole and configured to blow air toward the cylindrical transfer body through the blowoff hole.

7. A printing apparatus comprising:

a cylindrical transfer body;

a plurality of ink ejection heads for ejecting ink on to the cylindrical transfer body;

a transfer unit configured to transfer the image printed on the cylindrical transfer body to a sheet:

a reaction liquid ejection head for ejecting reaction liquid reacting with the ink; and a plurality of mist collection units configured to collect mist generated by the ejection heads, each of the mist collection units including an air blowoff hole and an air suction hole, a mist collection unit being disposed adjacent to each of an upstream side and a downstream side of the reaction liquid ejection head, a first mist collection unit of the plurality of mist collection units being disposed on an upstream side of a vertical line passing through a center of the cylindrical transfer body in a rotation direction of the cylindrical transfer body, the first mist collection unit including a holding portion for holding liquefied liquid sucked from the suction hole of the first mist collection unit, the holding portion of the first mist collection unit being located on an upstream side of the suction hole of the first mist collection unit in the rotation direction, a second mist collection unit of the plurality of mist collection units being disposed on a downstream side of the vertical line, the second mist collection unit including a holding portion for holding liquefied liquid sucked from the suction hole of the second mist collection unit, the holding portion of the second mist collection being located on a downstream side of the suction hole of the second mist collection unit in the rotation direction, wherein the reaction liquid ejection head is disposed adjacent to at least one of the ink ejection head disposed in the most upstream side in the rotation direction and the ink ejection head disposed in the most downstream side in the rotation direction with one of the mist collection units of the plurality of mist collection units disposed therebetween.

8. The printing apparatus according to claim 7, wherein each of the mist collection units is configured so that each of the blowoff hole and the suction hole has a longitudinal slit in a direction orthogonal to the rotation direction and the slit has a length longer than that of an ejection port array of the ink ejection heads adjacent to the slit.

9. The printing apparatus according to claim 7, wherein each of the mist collection units includes a housing, the blowoff hole and the suction hole being provided at the bottom of the housing, and a holding portion provided in the housing for holding liquefied liquid sucked through the suction hole.

* * * * *